US005738978A

United States Patent [19]

Yoshida et al.

[11] Patent Number: 5,738,978

[45] Date of Patent: Apr. 14, 1998

[54] METHOD FOR PROCESSING SILVER HALIDE COLOR PHOTOGRAPHIC MATERIAL AND PROCESSING COMPOSITION THEREFOR

[75] Inventors: Kazuaki Yoshida; Jun Noguchi; Kiyoshi Morimoto, all of Kanagawa, Japan

[73] Assignee: Fuji Photo Film Co., Ltd., Kanagawa, Japan

[21] Appl. No.: 773,361

[22] Filed: Dec. 26, 1996

[30] Foreign Application Priority Data

Dec. 26, 1995 [JP] Japan ..... 7-350737

[51] Int. Cl.[6] ..... G03C 5/29

[52] U.S. Cl. ..... 430/372; 430/428; 430/429; 430/490

[58] Field of Search ..... 430/434, 435, 430/357, 372, 428, 429, 490

[56] References Cited

U.S. PATENT DOCUMENTS 4,968,588 11/1990 Ishikawa et al. ..... 430/434
5,302,995 4/1994 Hayashi ..... 396/630

*Primary Examiner*—Hoa Van Le
*Attorney, Agent, or Firm*—Sughrue, Mion, Zinn, Macpeak & Seas, PLLC

[57] ABSTRACT

A method for processing a silver halide color photographic material comprising a step of processing an exposed silver halide color photographic material with an automatic processor, a color developing solution used in the processing step containing triisopropanolamine, and a conveying rate of the automatic processor being 1,100 mm/min. or more.

13 Claims, No Drawings

METHOD FOR PROCESSING SILVER HALIDE COLOR PHOTOGRAPHIC MATERIAL AND PROCESSING COMPOSITION THEREFOR

FIELD OF THE INVENTION

The present invention relates to a method for processing a silver halide photographic material and, in particular, to a method for processing a silver halide photographic material which is prevented from the influence to photographic properties by the contamination of a color developing solution by the mixture of a bleach-fixing solution.

BACKGROUND OF THE INVENTION

The processing of a silver halide color photographic material fundamentally comprises color development and desilvering processes, and delivering comprises bleaching and fixing processes or one bath type bleach-fixing process which is used alone or in combination with these processes. Washing, stopping, stabilizing processes and a pretreatment for acceleration of development may be added besides these processes, if required.

In recent years, rapid processing which uses the photographic papers of high silver chloride content emulsions and the processing thereof disclosed in WO 87/04534 has been predominant in color print. However, an emulsion of a high silver chloride content has a problem such that photographic properties, in particular, the sensitivity of a cyan coloring layer and gradation extremely fluctuate by the mixture of a bleach-fixing solution and a fixing solution into a color developing solution.

Among the components of a bleach-fixing solution and a fixing solution mixed into a color developing solution, a thiosulfate ion fixing agent largely affects photographic properties. This is because solution physical development is accelerated by a thiosulfate ion. A high silver chloride content emulsion is highly soluble, therefore, the influence is large.

For the purpose of preventing the fluctuation of photographic properties due to the mixture of a thiosulfate ion, a color developing solution containing a specific molecular weight of polyethylene glycol and a bromine ion is disclosed in JP-B-3-18176 (the term "JP-B" as used herein means an "examined Japanese patent publication"), also, a color developing solution containing a specific molecular weight of polyvinyl pyrrolidone and a bromine ion is disclosed in JP-B-3-15733. However, the effects of these techniques are insufficient, and not so far as to resolve the problem when a high silver chloride content emulsion is used. In addition, the faster the conveying rate of an automatic processor, the larger is the influence by the mixture of a thiosulfate ion, which has been a large problem, in particular, when a high silver chloride content emulsion is processed by an automatic processor of a conveying rate of 1,500 mm/min. or more.

The mixture of the components of a bleach-fixing solution and a fixing solution is caused by mans of so-called back contamination by a conveying leader, a belt, a hanger, etc., and the capillarity through the crystallization to the tank wall of the adjacent processing tank.

The former is capable of avoiding by washing a conveying leader, a belt, a hanger, etc., but the crystallization to the tank wall has been a large problem. The technique of the addition of a water-soluble polymer to a color developing solution for preventing the crystallization to the tank wall is disclosed in WO 91/17481, but the effect is not sufficient and not so far as to resolve the problem yet.

SUMMARY OF THE INVENTION

Accordingly, an object of the present invention is to conspicuously reduce the fluctuation of photographic properties caused by the contamination of a color developing solution by the mixture of a bleach-fixing solution and a fixing solution into a color developing solution.

Another object of the present invention is to prevent the crystallization to the tank wall which causes the above-described mixture.

Other objects and effects of the present invention will be apparent from the following description.

As a result of various investigations about the above problem, the present inventors have found the objects of the present invention can be attained by the processing method shown below.

(1) A method for processing a silver halide color photographic material comprising a step of processing an exposed silver halide color photographic material with an automatic processor, a color developing solution used in the processing step containing triisopropanolamine, and a conveying rate of the automatic processor being 1,100 mm/min. or more.

(2) A method for processing a silver halide color photographic material as described in (1), wherein the color developing solution contains $1\times10^{-3}$ mol/liter or more of calcium.

(3) A method for processing a silver halide color photographic material as described in (1) or (2), wherein the color developing solution contains $1\times10^{-2}$ mol/liter or more of lithium.

(4) A color developing solution composition for a silver halide color photographic material, the color developing solution composition containing triisopropanolamine and $1\times10^{-3}$ mol/liter or more of calcium.

(5) A color developing solution composition for a silver halide color photographic material, the color developing solution composition containing triisopropanolamine and $1\times10^{-2}$ mol/liter or more of lithium.

The use of triisopropanolamine in the composition of a black-and-white developing solution and a diffusion transfer processing solution has been disclosed in JP-A-48-43813 (the term "JP-A" as used herein means an "unexamined published Japanese patent application"), JP-A-48-68231 and JP-A-48-30497, but there are no disclosures about the examples of using triisopropanolamine in a color developing solution.

Moreover, it has been an unexpected finding that, contrary to conventional cases, the above problem can be resolved by the combination with a high speed automatic processor of a conveying rate of 1,100 mm/min. or more.

The fact of the influence by the mixture of a bleach-fixing solution being different according to the conveying rate is probably due to the difference of conditions of stirring during development. Acceleration of physical development by the mixture of a bleach-fixing solution is thought to be further accelerated as a conveying rate increases and the influence by the mixture of a bleach-fixing solution further increases. When a color developing solution contains triisopropanolamine, the influence by the mixture of a bleach-fixing solution reduces with the increase of the conveying rate. This is presumably because the effect of triisopropanolamine remarkably increases by the increase of the conveying rate.

DETAILED DESCRIPTION OF THE INVENTION

The present invention will be described in detail below.

The "automatic processor" used herein include a processing apparatus comprising a processing tank containing a processing solution, by which a photographic material is processed, and a means for automatically conveying the photographic material.

The color developing solution according to the present invention contains triisopropanolamine.

The addition amount of triisopropanolamine to the color developing solution is preferably from 0.005 mol to 2.0 mol, more preferably from 0.01 mol to 1.0 mol, and most preferably from 0.02 mol to 0.5 mol, per liter of the color developing solution.

It is preferred for the color developing solution of the present invention to contain calcium in an amount of $1\times10^{-3}$ mol or more per liter of the color developing solution for preventing the fluctuation of photographic properties due to the mixture of a bleach-fixing solution and a fixing solution and preventing the crystallization to the tank wall which causes the above-described mixture. The addition amount of calcium is preferably from $2\times10^{-3}$ to $2\times10^{-2}$ mol, particularly preferably from $4\times10^{-3}$ to $1.5\times10^{-2}$ mol, per liter of the color developing solution.

In the present invention, calcium may be in the form of a calcium ion and a complex ion by a chelating agent. Calcium is sufficient if it is present in the color developing solution, and it may be added directly to the color developing solution, or it may be incorporated in the photographic material and dissolved from the photographic material into the color developing solution.

When calcium is directly added to the color developing solution of the present invention, calcium sulfate, calcium nitrate, calcium acetate, calcium oxalate, calcium hydroxide, calcium phosphate, calcium carbonate, calcium citrate, calcium tartrate, calcium chloride, and calcium bromide can be used, and when incorporated in the photographic material, they also can be used. Calcium can be added to gelatin used in the photographic material or may be included in a support of the photographic material.

It is preferred for the color developing solution of the present invention to contain lithium in an amount of $1\times10^{-2}$ mol or more per liter of the color developing solution for preventing the fluctuation of photographic properties due to the mixture of a bleach-fixing solution and a fixing solution and preventing the crystallization to the tank wall which causes the above-described mixture.

The addition amount of lithium is preferably from $1.5\times10^{-2}$ to $5\times10^{-1}$ mol, particularly preferably from $2\times10^{-2}$ to $2\times10^{-1}$ mol, per liter of the color developing solution.

In the present invention, lithium may be in the form of a lithium ion and a complex ion by a chelating agent. Lithium is sufficient if it is present in the color developing solution, and it may be added directly to the color developing solution, or it may be incorporated in the photographic material and dissolved from the photographic material into the color developing solution.

In the present invention, lithium may be added in the form of lithium acetate, lithium bromide, lithium carbonate, lithium chloride, lithium citrate, lithium hydroxide, lithium nitrate, lithium oxalate, lithium phosphate, lithium sulfate, and lithium borate.

In the present invention, the linear velocity of conveyance of an automatic processor is 1,100 mm/min. or more, preferably from 1,300 mm/min. to 60,000 mm/min., more preferably from 1,500 mm/min. to 60,000 mm/min., particularly preferably from 2,000 to 60,000 mm/min., and most preferably from 3,000 to 60,000 mm/min. If the conveying rate is faster than 60,000 mm/min., it is not desired in view of stable conveying ability.

The color developing solution replenisher and the color developing solution which are used in the present invention are described below.

The color developing solution replenisher and the color developing solution for use in the present invention contain conventionally known aromatic primary amine color developing agents. Preferred examples are p-phenylenediamine derivatives, and representative examples thereof include N,N-diethyl-p-phenylenediamine, 2-amino-5-diethylaminotoluene, 2-amino-5-(N-ethyl-N-laurylamino) toluene, 4-[N-ethyl-N-(β-hydroxyethyl)amino]aniline, 2-methyl-4-[N-ethyl-N-(β-hydroxy-ethyl)amino]aniline, 2-methyl-4-[N-ethyl-N-(β-hydroxybutyl)-amino]aniline, 4-amino-3-methyl-N-ethyl-N-[β-(methanesulfonamido) ethyl]aniline, N-(2-amino-5-diethylaminophenylethyl)-methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. 4-Amino-3-methyl-N-ethyl-N-[β-(methanesulfonamido) ethyl]aniline and 2-methyl-4-[N-ethyl-N-(β-hydroxybutyl) amino]aniline are particularly preferred of them.

Further, these p-phenylenediamine derivatives may take the form of a salt such as sulfate, hydrochloride, sulfite, and p-toluenesulfonate. The amount used of the aromatic primary amine developing agent is generally from about 4 mmol to 50 mmol per liter of the color developing solution, and the amount used in the color developing solution replenisher is preferably in the concentration of from about 20 mmol to 100 mmol, more preferably from about 28 mmol to 75 mmol per liter of the replenisher.

It is preferred in the present invention to include p-toluenesulfonic acid in the color developing solution. p-Toluenesulfonic acid may be added as a counter salt of a color developing agent or may be added separately. The preferred content is generally from 0.1 to 100 g, preferably from 1 to 50 g, and more preferably from 3 to 30 g, as p-toluenesulfonic acid, per liter of the color developing solution.

The use of substantially benzyl alcohol free color developing solution replenisher and color developing solution is preferred for the execution of the present invention. The terminology "substantially benzyl alcohol free" used herein means that the benzyl alcohol concentration is preferably 2 ml/liter or less, more preferably 0.5 ml/liter or less, and most preferably the color developing solution replenisher and the color developing solution do not contain benzyl alcohol at all.

The use of substantially sulfite free and hydroxylamine free color developing solution replenisher and color developing solution is preferred. The terminology "substantially free" used herein means that the content thereof is 4 mmol or less per liter of the color developing solution replenisher and color developing solution, more preferably 2 mmol or less, and most preferably not containing at all.

The inclusion of the compound represented by the following formula (I) is preferred in the present invention. In particular, the preservability is conspicuously improved by the presence of the compound represented by formula (I).

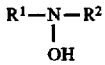

(I)

wherein $R^1$ and $R^2$ each represents a hydrogen atom, a substituted or unsubstituted alkyl group, a substituted or unsubstituted alkenyl group, a substituted or unsubstituted aryl group, or a heterocyclic aromatic group. $R^1$ and $R^2$ do not represent a hydrogen atom at the same time, and they may be linked each other to form a heterocyclic ring together with the nitrogen atom. The ring structure of the heterocyclic ring is a 5- or 6-membered ring comprising a carbon atom, a hydrogen atom, a halogen atom, an oxygen atom, a nitrogen atom and a sulfur atom, and saturated or unsaturated.

$R^1$ and $R^2$ preferably represent an alkyl group or an alkenyl group having preferably from 1 to 10, particularly preferably from 1 to 5, carbon atoms. Examples of the nitrogen-containing heterocyclic ring formed by linking of $R^1$ and $R^2$ include a piperidyl group, a pyrrolidyl group, an N-alkylpiperadyl group, a morpholyl group, an indolinyl group and a benzotriazole group.

Specific examples of compounds represented by formula (I) of the present invention are shown below, but the present invention is not limited thereto.

The addition amount of the following compounds to the color developing solution and the color developing solution replenisher is preferably such that the concentration becomes from 0.005 mol/liter to 0.5 mol/liter, more preferably from 0.03 mol/liter to 0.1 mol/liter.

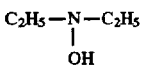

I-1

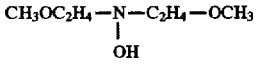

I-2

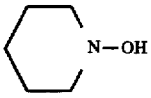

I-3

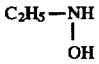

I-4

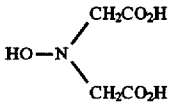

I-5

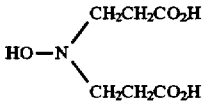

I-6

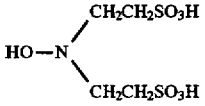

I-7

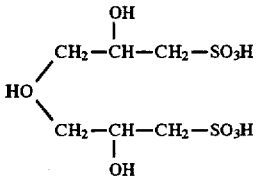

I-8

-continued

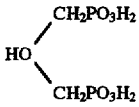

I-9

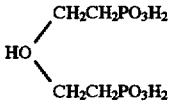

I-10

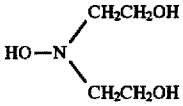

I-11

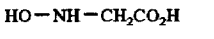

I-12

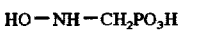

I-13

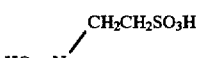

I-14

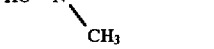

I-15

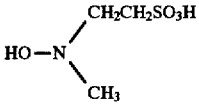

I-16

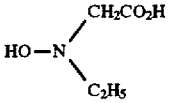

I-17

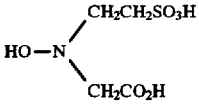

I-18

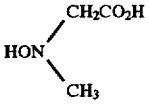

I-19

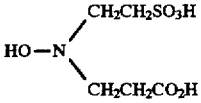

I-20

Organic preservatives other than the compounds represented by formula (I) may be used in addition to the compounds represented by formula (I) in the present invention, if necessary.

Organic preservatives herein means general organic compounds which reduce the deterioration speed of the aromatic primary amine color developing agent when added to a processing solution for a color photographic material. That is, organic preservatives herein means organic compounds which have functions to prevent the air oxidation of color developing agents and, above all, hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamide compounds, and condensed ring amines are particularly effective organic preservatives. These organic preservatives are disclosed in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-1-97953, JP-A-1-186939, JP-A-1-186940, JP-A-1-187557, and JP-A-2-306244. The various metals disclosed in JP-A-57-44148 and JP-A-57-53749, the salicylic acids disclosed in JP-A-59-180588, the amines disclosed in JP-A-63-239447, JP-A-63-128340, JP-A-1-186939 and JP-A-1-187557, the alkanolamines disclosed in JP-A-54-3532, the polyethyleneimines disclosed in JP-A-56-94349, and the aromatic polyhydroxy compounds disclosed in U.S. Pat. No. 3,746,544 may be used as preservatives, if necessary.

The addition amount of the organic preservative is generally from 0.005 to 0.5 mol, preferably from 0.03 to 0.1 mol, per liter of the developing solution.

The inclusion of aromatic polyhydroxy compounds is particularly preferred in the present invention from the viewpoint of the improvement of the stability of the developing solution.

In general, aromatic polyhydroxy compounds are compounds which have at least 2 hydroxy groups at the ortho positions to each other on the aromatic ring. Preferably, these polyhydroxy compounds are compounds which have at least 2 hydroxy groups at the ortho positions to each other on the aromatic ring and do not have exocyclic unsaturation. The various aromatic polyhydroxy compounds of a wide range of the present invention include the compounds represented by the following formula (II) such as benzene and naphthalene compounds.

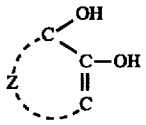

(II)

wherein Z represents an atomic group necessary to complete an aromatic nucleus of benzene or naphthalene.

The above compounds may be substituted with a group or an atom such as, for example, a sulfo group, a carboxyl group or a halogen atom, in addition to the hydroxy group.

General examples of aromatic polyhydroxy compounds which are preferably used in the present invention include the following:

II-1 Pyrocatechol

II-2 4,5-Dihydroxy-m-benzene-1,3-disulfonic acid

II-3 Disodium 4,5-dihydroxy-m-benzene-1,3-disulfonate

II-4 Tetrabromopyrocatechol

II-5 Pyrogallol

II-6 Sodium 5,6-dihydroxy-1,2,4-benzenetrisulfonate

II-7 Gallic acid

II-8 Methyl gallate

II-9 Propyl gallate

II-10 2,3-Dihydroxynaphthalene-6-sulfonic acid

II-11 2,3,8-Trihydroxynaphthalene-6-sulfonic acid

These compounds are included in the color developing solution or the color developing solution replenisher, and the addition amount may be from 0.00005 to 0.1 mol, generally from 0.0002 to 0.04 mol, and preferably from 0.0002 to 0.004 mol, per liter of the developing solution.

The color developing solution for use in the present invention has pH of preferably from 9 to 12, and more preferably from 9 to 11.0. Other known developing solution component compounds can be included in the color developing solution.

The color developing solution replenisher for use in the present invention has pH of preferably from 11 to 14, and more preferably from 11.5 to 13.5. pH of from 12.0 to 13.0 is particularly preferred from the viewpoint of prevention of the precipitation of the replenisher and the reduced replenishing rate.

The use of various buffers is preferred for maintaining the above pH level. Examples of buffers which can be used include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, anlanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are excellent in solubility and buffering ability in a high pH range of pH 9.0 or more, and do not adversely affect photographic properties (such as to cause fogging) when added to the color developing solution and inexpensive, therefore, the use of these buffers is particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

Buffers are added to the color developing solution and the color developing solution replenisher in an amount of preferably 0.1 mol/liter or more, and particularly preferably from 0.1 mol/liter to 0.4 mol/liter.

Various chelating agents can be used in the color developing solution of the present invention for preventing the precipitation of calcium and magnesium or improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and hydroxyethyliminodiacetic acid. These chelating agents may be used in combination of two or more of them, if required.

The addition amount of these chelating agents should be sufficient to mask the metal ions present in the color developing solution, and the amount is, for example, about 0.1 g to 10 g per liter.

The color developing solution can contain a development accelerator, if desired.

For example, the thioether based compounds disclosed in JP-B-37-16088, JP-B-37-5987, JP-B-38-7826, JP-B-44-12380, JP-B-45-9015 and U.S. Pat. No. 3,318,247, the p-phenylenediamine based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary. Benzyl alcohol is as described above.

The addition amount of the development accelerator is generally from 0.001 to 1 mol, preferably from 0.01 to 0.5 mol, per liter of the developing solution.

An antifoggant can be included arbitrarily in the present invention, if desired. Alkali metal halides such as sodium chloride, potassium bromide and potassium iodide, and organic antifoggants can be used as an antifoggant. Specific examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The chlorine ion concentration in the color developing solution of the present invention is preferably from $5\times10^{-2}$ to $2\times10^{-1}$ mol/liter from the point of preventing the fluctuations in photographic properties, more preferably from $6\times10^{-2}$ to $1.5\times10^{-1}$ mol/liter, and particularly preferably from $8\times10^{-2}$ to $1.3\times10^{-1}$ mol/liter.

Further, the bromine ion concentration in the color developing solution of the present invention is preferably from $1\times10^{-4}$ to $4\times10^{-4}$ mol/liter in view of preventing the fluctuations in photographic properties, more preferably from $1.2\times10^{-4}$ to $3.8\times10^{-2}$ mol/liter, and particularly preferably from $1.5\times10^{-4}$ to $3.5\times10^{-4}$ mol/liter. In addition, it is most preferred that both chlorine ion and bromine ion in the above cited ranges exist together.

The color developing solution and the color developing solution replenisher of the present invention can contain a fluorescent brightening agent, if desired.

Triazinyl-4,4-diaminostilbene based compounds are preferred as a fluorescent brightening agent. Above all, the compounds represented by the following formula (SR) are preferred in view of solubility to the replenisher, prevention of the precipitation of the replenisher and the reduced stain of the photographic material after being processed.

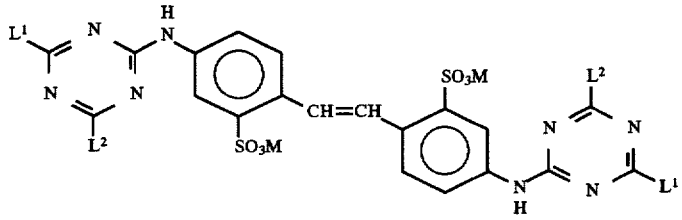

(SR)

wherein $L^1$ and $L^2$, which may be the same or different, each represents $—OR^1$ or $—NR^2R^3$ (wherein $R^1$, $R^2$ and $R^3$ each represents a hydrogen atom or an alkyl group), and satisfies at least one of the following conditions (1) and (2).

(1) Four substituents $L^1$'s and $L^2$'s in formula (SR) have the total substituents of 4 or more selected from formula (A) group. (2) Four substituents $L^1$'s and $L^2$'s in formula (SR) have the total substituents of 2 selected from formula (A) group and the total substituents of 2 or more selected from formula (B) group.

Formula (A) Group $—SO_3M$, $—OSO_3M$, $—COOM$, $—NR_3X$

Formula (B) Group $—OH$, $—NH_2$, $—CN$, $—NHCONH_2$

In formula (A) group, X represents a halogen atom and R represents an alkyl group.

In formula (SR) and formula (A) group, M represents a hydrogen atom, an alkaline earth metal, ammonium or pyridinium.

The diaminostilbene based brightening agents represented by formula (SR) for use in the present invention are exemplified as specific structures in which $L^1$ and $L^2$ are represented by the following atomic groups, however, the present invention is not limited thereto.

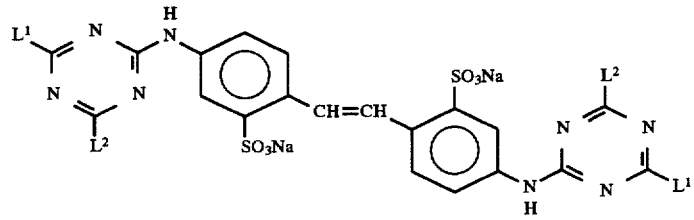

| Cpd. No. | $L^1$ | $L^2$ |
|---|---|---|
| SR-1 | $—NHCH_2CH(CH_3)SO_3Na$ | $—NHCH_2CH(CH_3)SO_3Na$ |
| SR-2 | $—OC_2H_4OSO_3Na$ | $—OC_2H_4OSO_3Na$ |

-continued

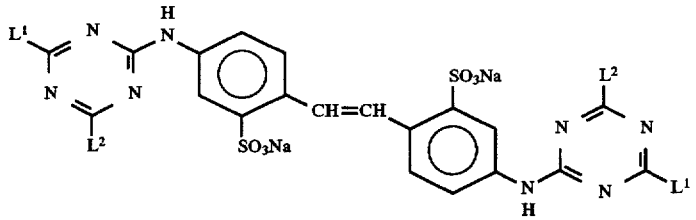

| Cpd. No. | $L^1$ | $L^2$ |
|---|---|---|
| SR-3 | $-N(C_2H_4OSO_3Na)_2$ | $-N(C_2H_4OSO_3Na)_2$ |
| SR-4 | $-OC_2H_4SO_3H$ | $-OC_2H_4SO_3H$ |
| SR-5 | $-NHC_2H_4SO_3H$ | $-NHC_2H_4SO_3H$ |
| SR-6 | $-NHC_2H_4SO_3(NH_4)$ | $-NHC_2H_4SO_3(NH_4)$ |
| SR-7 | $-NHC_2H_4COOH$ | $-NHC_2H_4COOH$ |
| SR-8 | " | $-NHC_2H_4SO_3Na$ |
| SR-9 | $-NHC_2H_4COONa$ | $-NHC_2H_4COONa$ |
| SR-10 | " | $-NHC_2H_4SO_3Na$ |
| SR-11 | $-N(CH_3)_3Cl$ | $-N(CH_3)_3Cl$ |

TABLE 2

| Cpd. No. | $L^1$ | $L^2$ |
|---|---|---|
| SR-12 | $-OC_2H_4SO_3Na$ | $-OC_2H_4SO_3Na$ |
| SR-13 | $-NHC_2H_4SO_3Na$ | $-NHC_2H_4SO_3Na$ |
| SR-14 | $-N(CH_3)(C_2H_4SO_3Na)$ | $-N(CH_3)(C_2H_4SO_3Na)$ |
| SR-15 | $-N(C_2H_5)(C_2H_4SO_3Na)$ | $-N(C_2H_5)(C_2H_4SO_3Na)$ |
| SR-16 | $-N(C_2H_4SO_3Na)_2$ | $-N(C_2H_4SO_3Na)_2$ |
| SR-17 | $-N(C_2H_4SO_3Na)_2$ | $-OCH_3$ |
| SR-18 | " | $-OH$ |
| SR-19 | " | $-OC_2H_4OH$ |
| SR-20 | " | $-NH_2$ |

TABLE 2-continued

| Cpd. No. | $L^1$ | $L^2$ |
|---|---|---|
| SR-21 | " | $-NHC_2H_4OH$ |
| SR-22 | " | $-OC_2H_4NH_2$ |
| SR-23 | " | $-NHC_2H_4N(CH_3)_2$ |
| SR-24 | $-NHC_2H_4SO_3Na$ | $-OC_2H_4SO_3Na$ |
| SR-25 | " | $-N(CH_3)(C_2H_4SO_3Na)$ |
| SR-26 | " | $-N(C_2H_4OSO_3Na)_2$ |
| SR-27 | " | $-NHCH_2CH(CH_3)SO_3Na$ |

TABLE 3

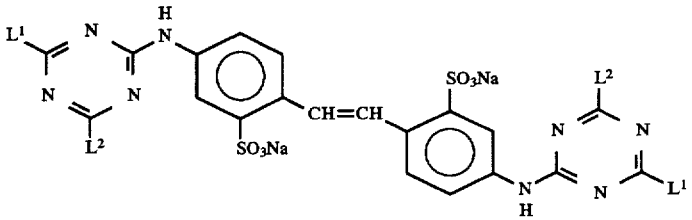

| Cpd No | $L^1$ | $L^2$ |
|---|---|---|
| SR-28 | $-OC_2H_4SO_3Na$ | $-OH$ |
| SR-29 | " | $-OC_2H_4NH_2$ |
| SR-30 | " | $-OCH_2CH(OH)CH_3$ |
| SR-31 | " | $-OC_2H_4OH$ |
| SR-32 | " | $-NH_2$ |

TABLE 3-continued

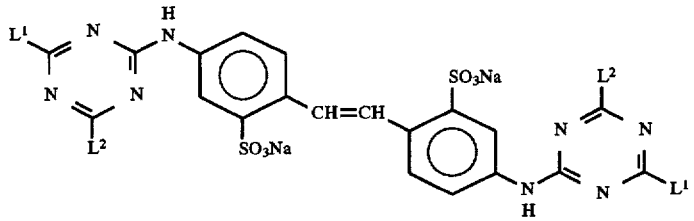

| Cpd No | $L^1$ | $L^2$ |
|---|---|---|
| SR-33 | " | $-N(C_2H_4OH)_2$ |
| SR-34 | " | $-NHC_2H_4OH$ |
| SR-35 | $-NHC_2H_4SO_3Na$ | $-OH$ |
| SR-36 | " | $-OC_2H_4NH_2$ |
| SR-37 | " | $-OCH_2CH(OH)CH_3$ |
| SR-38 | " | $-OC_2H_4OH$ |
| SR-39 | " | $-NH_2$ |
| SR-40 | " | $-N(C_2H_4OH)_2$ |
| SR-41 | " | $-NHC_2H_4OH$ |

TABLE 4

| Cpd. No. | $L^1$ | $L^2$ |
|---|---|---|
| SR-42 | $-NHC_2H_4SO_3Na$ | $-N(CH_3)(C_2H_4OH)$ |
| SR-43 | " | $-NHC_2H_4NHCONH_2$ |
| SR-44 | " | $-NHCH(CH_3)CH_2OH$ |
| SR-45 | " | $-N(C_2H_4OH)_2$ |
| SR-46 | " | $-OC_2H_4OSO_3Na$ |
| SR-47 | $-NHC_2H_4SO_3H$ | $-OH$ |
| SR-48 | " | $-OC_2H_4NH_2$ |
| SR-49 | " | $-OCH_2CH(OH)CH_3$ |
| SR-50 | " | $-OC_2H_4OH$ |
| SR-51 | " | $-NH_2$ |
| SR-52 | " | $-N(C_2H_4OH)_2$ |
| SR-53 | " | $-NHC_2H_4OH$ |
| SR-54 | " | $-N(CH_3)(C_2H_4OH)$ |

TABLE 5

| Cpd. No. | $L^1$ | $L^2$ |
|---|---|---|
| SR-55 | $-N(CH_3)(C_2H_4SO_3Na)$ | $-OH$ |
| SR-56 | " | $-OC_2H_4NH_2$ |
| SR-57 | " | $-OC_2H_4OH$ |
| SR-58 | " | $-NHC_2H_4OH$ |

TABLE 5-continued

| Cpd. No. | $L^1$ | $L^2$ |
|---|---|---|
| SR-59 | " | $-N(C_2H_4OH)_2$ |
| SR-60 | $-OC_2H_4OSO_3Na$ | $-OH$ |
| SR-61 | " | $-OC_2H_4NH_2$ |
| SR-62 | " | $-OC_2H_4COOH$ |
| SR-63 | " | $-NH_2$ |
| SR-64 | " | $-NHC_2H_4OH$ |
| SR-65 | " | $-N(C_2H_4OH)_2$ |
| SR-66 | $-NHC_2H_4COONa$ | $-OH$ |
| SR-67 | " | $-OC_2H_4NH_2$ |
| SR-68 | " | $-OC_2H_4OH$ |

TABLE 6

| Cpd. No. | $L^1$ | $L^2$ |
|---|---|---|
| SR-69 | $-NHC_2H_4COONa$ | $-NH_2$ |
| SR-70 | " | $-N(C_2H_4OH)_2$ |
| SR-71 | " | $-NHC_2H_4OH$ |

The compounds represented by formula (SR) may be used alone or may be used together with a plurality of other diaminostilbene based compounds, but in the case of the combined use the compounds to be used together are preferably the compounds represented by formula (SR) or the compounds represented by the following formula (SR-c).

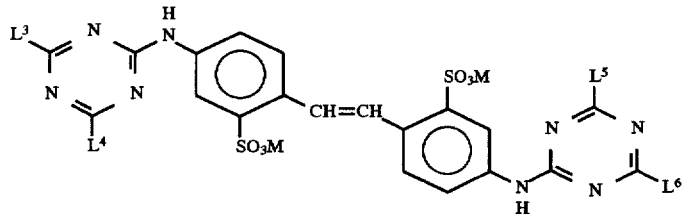

(SR-c)

wherein $L^3$, $L^4$, $L^5$ and $L^6$, which may be the same or different, each represents —$OR^8$ or —$NR^9R^{10}$, $R^8$, $R^9$ and $R^{10}$ each represents a hydrogen atom, an alkyl group, or an alkyl group which may be substituted.

Specific examples of the compounds represented by formula (SR-c) are shown in Table 7 below.

TABLE 7

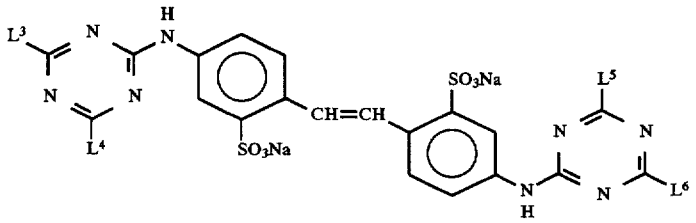

| Cpd. No. | $L^3$ | $L^4$ | $L^5$ | $L^6$ |
|---|---|---|---|---|
| B-1 | $-NHC_2H_4SO_3Na$ | $-OCH_3$ | $-OCH_3$ | $-N(C_2H_4OH)_2$ |
| B-2 | $-NHC_2H_4SO_3Na$ | $-OCH_3$ | $-OCH_3$ | $-NHC_2H_4OH$ |
| B-3 | $-NHC_2H_4SO_3Na$ | $-NHC_2H_5$ | $-NHC_2H_5$ | $-NHC_2H_4OH$ |
| B-4 | $-NHC_2H_4OH$ | $-NHC_2H_4OH$ | $-NHC_2H_4OH$ | $-NHC_2H_4OH$ |
| B-5 | $-OC_2H_4OH$ | $-OC_2H_4OH$ | $-OC_2H_4OH$ | $-OC_2H_4OH$ |
| B-6 | $-OC_2H_4OH$ | $-OH$ | $-OH$ | $-OC_2H_4OH$ |
| B-7 | $-OC_2H_4OH$ | $-NH_2$ | $-NH_2$ | $-OC_2H_4OH$ |
| B-8 | $-OC_2H_4OH$ | $-OCH_3$ | $-OCH_3$ | $-OC_2H_4OH$ |
| B-9 | $-OC_2H_4OH$ | $-OC_2H_4NH_2$ | $-OC_2H_4NH_2$ | $-OC_2H_4OH$ |
| B-10 | $-NHC_2H_4OH$ | $-OC_2H_5$ | $-OC_2H_5$ | $-NHC_2H_4OH$ |
| B-11 | $-OC_2H_4OH$ | $-NHC_2H_5$ | $-NHC_2H_5$ | $-OC_2H_4OH$ |
| B-12 | $-N(C_2H_5)(C_2H_4OH)$ | $-OH$ | $-OH$ | $-N(C_2H_4)(C_2H_4OH)$ |

Moreover, commercially available diaminostilbene based fluorescent brightening agents may be used together with the compounds represented by formula (SR) of the present invention. Examples of commercially available compounds are disclosed in *Senshoku Note* (Dyeing Note), 19th Ed., pp. 165 to 168, Senshoku-sha, and Whitex RP or Whitex BRF liq. are preferred of them.

The addition amount of the fluorescent brightening agent is generally from 0.01 to 10 g, preferably from 0.1 to 5 g, per liter of the developing solution.

Further, various kinds of surfactants can be added, if desired. Specific examples of surfactants include compounds represented by formulae (I) and (II) of JP-A-4-195037 and compounds represented by formulae (I) to (X) of JP-A-4-81750.

In addition, it is preferred to set the surface tension of the color developing solution and the color developing solution replenisher at 20 to 60 dyne/cm by the addition of the above compounds.

The addition amount of the surfactant is generally from 0.001 to 10 g, preferably from 0.01 to 5 g, per liter of the developing solution.

The compounds represented by formula (I) of JP-A-5-333505 are particularly preferably used to prevent precipitation, in particular, the precipitation of the color developing agent at the part where the tank or rack and the developing solution in the processing bath contact the air.

The processing temperature of the color developing solution applicable to the present invention is generally from 20° C. to 50° C., and preferably from 30° C. to 45° C. The processing time is generally from 20 seconds to 5 minutes, preferably from 30 seconds to 2 minutes.

The replenishing rate of the color developing solution in the present invention is appropriately from 20 to 1,000 ml, preferably from 30 to 200 ml, and more preferably from 35 to 80 ml, per $m^2$ of the photographic material.

It is preferred to cover the surface of the color developing solution replenisher, as well as the bleach-fixing solution replenisher, with a floatable liquid, which is described later, from the viewpoint of improving stability.

The desilvering process applicable to the present invention is described below.

The desilvering process is conducted by the combination of a bleaching process, a fixing process and a bleach-fixing process. Representative examples are shown below.

(1) Bleaching-fixing (2) Bleaching-bleach-fixing (3) Bleaching-bleach-fixing-fixing
(4) Bleaching-water washing-fixing
(5) Bleach-fixing
(6) Fixing-bleach-fixing (5) is particularly preferably used in the present invention.

The processing solution having the bleaching ability (a general name for a bleaching solution and a bleach-fixing solution) is described below. It is necessary for the processing solution having the bleaching ability to contain from 0.01 to 1 mol, more preferably from 0.03 to 0.5 mol, and particularly preferably from 0.05 to 0.5 mol, of a bleaching agent per liter of the processing solution.

As the bleaching agent for use in the processing solution having the bleaching ability, Fe(III), Co(III) or Mn(III) chelate bleaching agents of the following compounds, or persulfate (e.g., peroxodisulfate), hydrogen peroxide, bromate, etc., can be cited.

Examples of the compounds for forming the above chelating agent-based bleaching agents include ethylenediaminetetraacetic acid, diethylenetriaminepentaacetic acid, ethylenediamine-N-(B-oxyethyl)-N,N',N'-triacetic acid, 1,2-diaminopropanetetraacetic acid, 1,3-diaminopropanetetraacetic acid, nitrilotriacetic acid, nitrilo-N-2-carboxy-N,N-diacetic acid, N-(2-acetamido) iminodiacetic acid, cyclohexanediaminetetraacetic acid, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and sodium salts and ammonium salt of these compounds. 1,3-Diaminopropanetetraacetic acid, nitrilo-N-2-carboxy-N,N-diacetic acid, N-(2-acetamido)iminodiacetic acid and ethylenediaminetetraacetic acid are particularly preferred of them.

The compounds represented by the following formula (E) are also particularly preferred.

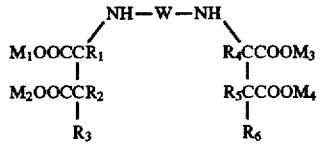

(E)

wherein $R_1$, $R_2$, $R_3$, $R_4$, $R_5$ and $R_6$ each represents a hydrogen atom, an aliphatic group, an aromatic group or a hydroxyl group; W represents a divalent linking group containing a carbon atom; and $M_1$, $M_2$, $M_3$ and $M_4$ each represents a hydrogen atom or a cation. Specific examples of the compounds represented by formula (E) are shown below.

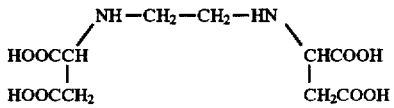

E-1.

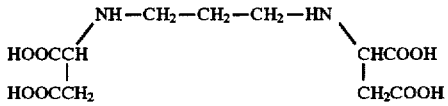

E-2.

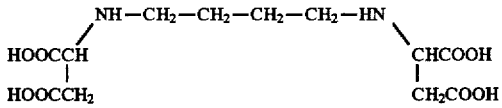

E-3.

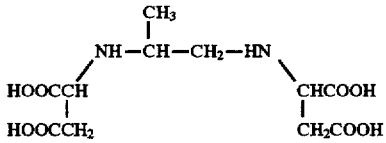

E-4.

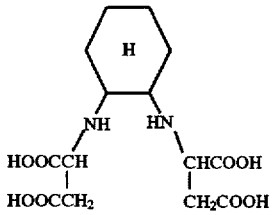

E-5.

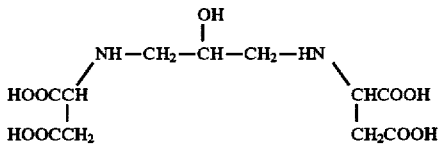

E-6.

-continued

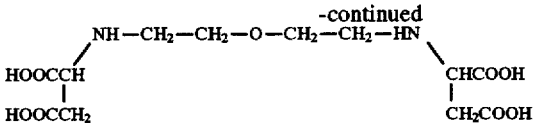

E-7.

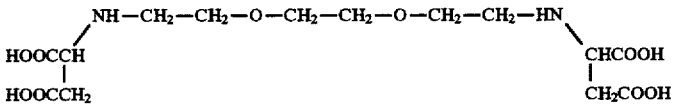

E-8.

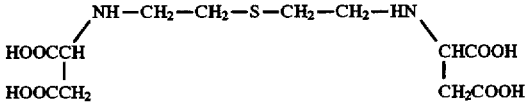

E-9.

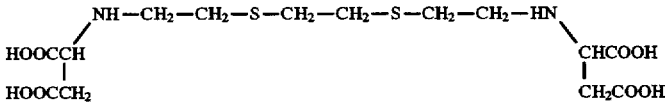

E-10.

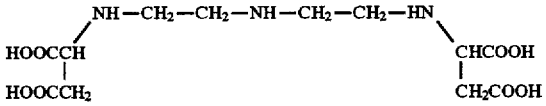

E-11.

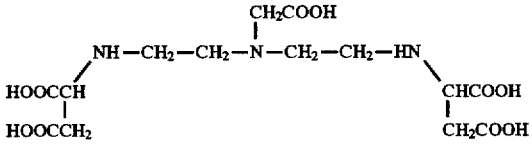

E-12.

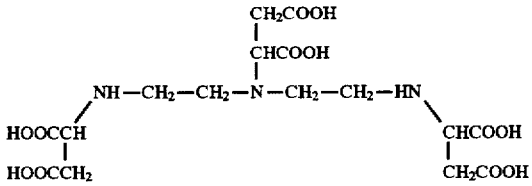

E-13.

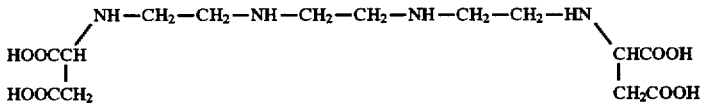

E-14.

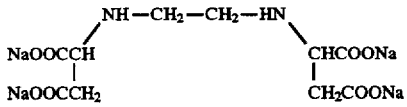

E-15.

The compounds represented by formula (E) may be any optical isomers.

They may be [S.S] isomer, [S.R] isomer, [R.S] isomer, or [R.R] isomer, or mixtures of these isomers. Above all, compounds synthesized from amino acid of L isomer as a raw material such as [S.S] isomers of compounds (E-1) and (E-2) are particularly preferred in the present invention in view of the stability of the bleach-fixing solution, desilvering ability and biodegradability.

It is preferred for the processing solution having the bleaching ability to contain halides such as chloride, bromide or iodide as a rehalogenating agent for accelerating oxidation of silver. Further, organic ligands which comprise scarcely soluble silver salt may be included in place of halides. Silver halides are added in the form of alkali metal salts or ammonium salt, or salts of guanidine, and amine. Specifically, there are potassium bromide, sodium bromide, ammonium bromide, potassium chloride, and guanidine hydrochloride, and preferably potassium bromide or sodium bromide. The amount of a rehalogenating agent to be added to the bleaching solution is appropriately 2 mol/liter or less, preferably from 0.01 to 2.0 mol/liter, and more preferably from 0.1 to 1.7 mol/liter.

The bleach-fixing solution contains a fixing agent (described later) and, further, can contain all other compounds contained in the fixing solution described later. Also, the bleach-fixing solution can contain the above-described rehalogenating agents, if required. The rehalogenating agent is contained in the bleach-fixing solution in an amount of from 0.001 to 2.0 mol/liter, and preferably from 0.001 to 1.0 mol/liter.

The bleaching solution or the bleach-fixing solution of the present invention can include, if desired, other additives such as a bleaching accelerator, a corrosion inhibitor for preventing the corrosion of processing tanks, a pH buffer for maintaining the pH of the processing solution, a brightening agent, and a defoaming agent.

Specific examples of bleaching accelerators which can be used in the present invention include, for example, the compounds having a mercapto group or a disulfide group disclosed in U.S. Pat. No. 3,893,858, German Patent 1,290,812, U.S. Pat. No. 1,138,842, JP-A-53-95630, and Research Disclosure, No. 17129 (1978), the thiazolidine derivatives disclosed in JP-A-50-140139, the thiourea derivatives disclosed in U.S. Pat. No. 3,706,561, the polyethylene oxides disclosed in German Patent 2,748,430, the polyamine compounds disclosed in JP-B-45-8836, and the imidazole compounds disclosed in JP-A-49-40493. The mercapto compounds disclosed in U.S. Pat. No. 1,138,842 are particularly preferred of them.

Further, nitrates such as ammonium nitrate, sodium nitrate, and potassium nitrate are preferably used as a corrosion inhibitor. The addition amount thereof is generally from 0.01 to 2.0 mol/liter, and preferably from 0.05 to 0.5 mol/liter.

The total of the ammonium ion concentration in the bleaching solution or the bleach-fixing solution according to the present invention is preferably 0.3 g ion/liter or less. This mode is preferred from the standpoint of image storage stability and environmental protection, and the concentration of 0.1 mol/liter or less is more preferred in the present invention.

The bleaching solution or the bleach-fixing solution according to the present invention has pH of from 2.0 to 8.0 and preferably from 3.0 to 7.5. When bleaching or bleach-fixing is conducted immediately after color development, the pH is 7.0 or less, preferably 6.4 or less, for preventing bleaching fog. In the case of the bleaching solution, in particular, pH of from 3.0 to 5.0 is preferred. If the pH is 2.0 or less, the metal chelating according to the present invention becomes unstable, therefore, the pH is preferably from 2.0 to 6.4.

Accordingly, any compounds which are difficult to be oxidized by the bleaching agent and have the buffering function at the above pH range can be used as a pH buffer in the present invention. Examples thereof include organic acids such as acetic acid, glycolic acid, lactic acid, propionic acid, butyric acid, malic acid, chloroacetic acid, levulinic acid, ureidopropionic acid, nitric acid, malonic acid, succinic acid, glutaric acid, maleic acid, fumaric acid, citraconic acid, itaconic acid, β-hydroxypropionic acid, tartaric acid, citric acid, oxalacetic acid, diglycolic acid, benzoic acid, and phthalic acid, and organic bases such as pyridine, dimethylpyrazole, 2-methyl-o-oxazoline, and aminoacetonitrile. These buffers can be used two or more in combination. Organic acids having pKa of from 2.0 to 5.5 are preferably used as buffers in the present invention, in particular, acetic acid and glycolic acid are preferably used either alone or in combination. The total addition amount of these buffers is 3.0 mol or less, preferably from 0.1 to 2.0 mol, per liter of the processing solution having the bleaching ability.

For controlling the pH of the processing solution having the bleaching ability within the above range, the above-described acids and alkali agents (e.g., aqueous ammonia, KOH, NaOH, imidazole, monoethanolamine, diethanoiamine) may be used in combination. KOH is particularly preferred above all.

The bleaching or bleach-fixing process can be carried out at 30° C. to 60° C. but is preferably conducted at 35° C. to 50° C.

The time of the bleaching and/or bleach-fixing processes is from 10 seconds to 2 minutes, preferably from 10 seconds to 1 minute, and more preferably from 15 seconds to 45 seconds. In these preferred processing conditions, rapid and desired results in which there is no increase of stain can be obtained.

Various known fixing agents are used in the bleach-fixing solution or the fixing solution of the present invention. Examples thereof include thiosulfates, thiocyanates, thioethers, amines, mercaptos, thiones, thioureas, iodides, and mesoionic compounds, for example, ammonium thiosulfate, sodium thiosulfate, potassium thiosulfate, guanidine thiosulfate, potassium thiocyanate, dihydroxyethyl thioether, 3,6-dithia-1,8-octanediol, and imidazole. Thiosulfates, in particular, ammonium thiosulfate, are preferably used for carrying out rapid fixing process. Further, a combined use of two or more fixing agents can ensure more rapid fixing process. For example, it is preferred to use, in addition to ammonium thiosulfate, the above described ammonium thiocyanate, imidazole, thiourea, and thioether, in combination, and in such a case, the addition amount of the second fixing agents is preferably from 0.01 to 100 mol % based on the ammonium thiosulfate.

The amount of the fixing agent is from 0.1 to 3.0 mol, preferably from 0.5 to 2.0 mol, per liter of the bleach-fixing solution or the fixing solution. The pH of the fixing solution varies according to the kind of the fixing agent but is generally from 3.0 to 9.0. When thiosulfate is used as the fixing agent, in particular, pH is preferably from 6.5 to 8.0 for obtaining stable capabilities.

The addition of preservatives to the bleach-fixing solution or the fixing solution can raise the stability of the solution with the lapse of time. Sulfites and/or hydroxylamines, hydrazines, bisulfite addition products of aldehyde (for example, bisulfite addition products of acetaldehyde, particularly preferably the bisulfite addition products of aromatic aldehyde disclosed in JP-A-1-298935) are effective as preservatives when the bleach-fixing solution or the fixing solution contains thiosulfate. The use of the sulfinic acid compounds disclosed in JP-A-62-143048 is also preferred.

Sulfinic acid or salt thereof is described in detail below.

$R(SO_2M)_4$ (S)

wherein R represents an alkyl group, an alkenyl group, an aralkyl group, a cycloalkyl group, an aryl group or a heterocyclic group; M represents a cation; and n represents 1 or 2.

The above-described formula (S) is described in detail below. R represents a substituted or unsubstituted alkyl group (e.g., methyl, ethyl, n-propyl, hydroxyethyl, sulfoethyl, carboxyethyl, methoxyethyl), a substituted or unsubstituted alkenyl group (e.g., allyl, butenyl), a substituted or unsubstituted aralkyl group (e.g., benzyl, phenethyl, 4-carboxyphenylmethyl, 3-sulfophenylmethyl), a substituted or unsubstituted cycloalkyl group (e.g., cyclohexyl), a substituted or unsubstituted aryl group (e.g., phenyl, 4-methylphenyl, naphthyl, 3-carboxyphenyl, 4-methoxyphenyl, 3-sulfophenyl, 4-carboxymethoxyphenyl, 3-carboxymethoxyphenyl, 4-carboxyethoxyphenyl, 4-sulfoethoxyphenyl, 4-carboxymethylphenyl, 4-(N-carboxymethyl-N-methyl) phenyl), or a substituted or unsubstituted heterocyclic group (e.g., pyridyl, furyl, thienyl, pyrazolyl, indolyl); M represents a cation (for example, a hydrogen atom, an alkali metal, an alkaline earth metal, a nitrogen-containing organic base or an ammonium group).

As an alkali metal, Na, K, and Li can be enumerated, as an alkaline earth metal, Ca and Ba, as a nitrogen-containing organic base, ordinary amines capable of forming salts with sulfinic acid, and as an ammonium group, an unsubstituted ammonium group and a tetramethylammonium group can be cited. In formula (S), when the groups represented by R have substituents, examples of the substituents include a nitro group, a halogen atom (e.g., chlorine, bromine), a cyano group, an alkyl group (e.g., methyl, ethyl, propyl, carboxymethyl, carboxyethyl, carboxypropyl, sulfoethyl, sulfopropyl, dimethylaminoethyl), an aryl group (e.g., phenyl, naphthyl, carboxyphenyl, sulfophenyl), an alkenyl group (e.g., allyl, butenyl), an aralkyl group (e.g., benzyl, phenethyl), a sulfonyl group (e.g., methanesulfonyl, p-toluenesulfonyl), an acyl group (e.g., acetyl, benzoyl), a carbamoyl group (e.g., unsubstituted carbamoyl, dimethylcarbamoyl), a sulfamoyl group (e.g., unsubstituted sulfamoyl, methylsulfamoyl, dimethylsulfamoyl), a carbonamido group (e.g., acetamido, benzamido), a sulfonamido group (e.g., methanesulfonamido, benzenesulfonamido), an acyloxy group (e.g., acetyloxy, benzoyloxy), a sulfonyloxy group (e.g., methanesulfonyloxy), a ureido group (e.g., unsubstituted ureido), a thioureido group (e.g., unsubstituted thioureido, methylthioureido), carboxylic acid or salts thereof, sulfonic acid or salts thereof, a hydroxyl group, an alkoxyl group (e.g., methoxy, ethoxy, carboxyethoxy, carboxymethoxy, sulfoethoxy, sulfopropyloxy), an alkylthio group (e.g., methylthio, carboxymethylthio, sulfoethylthio), and an amino group (e.g., unsubstituted amino, dimethylamino, N-carboxyethyl-N-methylamino).

In formula (S), R preferably represents a substituted or unsubstituted aryl group or a substituted or unsubstituted heterocyclic group, more preferably R represents an aryl group substituted with at least one of an alkyl group containing carboxylic acid or salts thereof or sulfonic acid or salts thereof, an alkoxyl group containing carboxylic acid or salts thereof or sulfonic acid or salts thereof, or an alkylamino group containing carboxylic acid or salts thereof or sulfonic acid or salts thereof.

In formula (S), n preferably represents 1. Herein, the above alkyl group, alkoxyl group or an alkylamino group preferably has 10 or less, more preferably 6 or less, carbon atoms. The substituent of the aryl group represented by R is at least one, but preferably from 1 to 3. The total carbon atom number of R is preferably 20 or less.

The above aryl group preferably represents a phenyl group or a naphthyl group, and more preferably a phenyl group. It is effective and preferred that the compound represented by formula (S) is contained in the color developing solution to prevent the fluctuation of photographic properties due to mixing of a bleach-fixing solution or a fixing solution into the color developing solution.

Specific compounds represented by formula (S) are shown below.

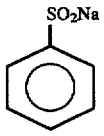

(S-1)

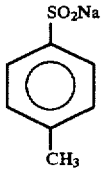

(S-2)

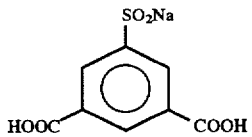

(S-3)

-continued

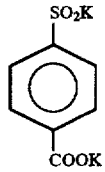

(S-4)

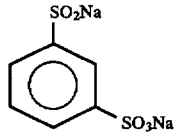

(S-5)

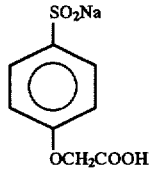

(S-6)

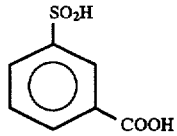

(S-7)

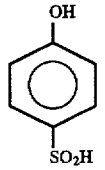

(S-8)

$CH_2SO_2NH_4$ (S-9)

$CH_3CH_2SO_2NH_4$ (S-10)

$CH_3CO_2Na$ (S-11)

$CH_3CH_2SO_2Na$ (S-12)

The above compounds can be used alone or in combination of two or more in admixture. The sulfinic acid compounds according to the present invention can be synthesized by referring to known literature, for example, *J. Am. Chem. Soc.*, 72, 1215 (1950), ibid., 62, 2596 (1940); ibid., 60, 544 (1938); ibid., 56, 1382 (1934); ibid., 57, 2166 (1935); ibid., 81, 5430 (1959); and *Chem. Rev.*, 48, 69 (1951) can be referred to.

The amount of the sulfinic acid for use in the present invention is generally from 0.001 to 1.0 mol/liter, and preferably from 0.002 to 0.2 mol/liter.

It is preferred for the bleach-fixing solution and the fixing solution to contain buffers for maintaining pH constant, for example, phosphates, imidazoles such as imidazole, 1-methylimidazole, 2-methylimidazole, and 1-ethylimidazole, triethanolamine, N-allylmorpholine, N-benzoylpiperazine, etc.

Further, various chelating agents can be used in the fixing solution to mask the iron ions carried over from the bleaching solution for improving the stability of the solution. Examples of such preferred chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, and 1,2-propanediaminetetraacetic acid.

Although the fixing process can be carried out in a range of between 30° C. and 60° C., preferably between 35° C. and 50° C. The processing time of the fixing process is from 5 seconds to 2 minutes, preferably from 10 seconds to 1 minute and 40 seconds, and more preferably from 10 seconds to 45 seconds.

The replenishing rate of the bleaching solution is from 20 to 900 ml, preferably from 20 to 500 ml, and more preferably from 30 to 250 ml, per m2 of the photographic material.

The replenishing rate of the bleach-fixing solution is from 20 to 1,500 ml, preferably from 30 to 600 ml, and more preferably from 30 to 200 ml, per $m^2$ of the photographic material. Further, the replenisher of the bleach-fixing solution may be replenished as one part solution or may be replenished separately as a bleaching composition and a fixing composition, alternatively the overflow from the bleaching tank and/or the fixing tank may be mixed to make a bleach-fixing replenisher.

The replenishing rate of the fixing solution is from 20 to 1,500 ml, preferably from 30 to 600 ml, and more preferably from 30 to 200 ml, per $m^2$ of the photographic material.

A method in which the overflow from the water washing tank or the stabilizing tank is introduced into the preceding processing tank having the fixing ability to thereby reduce the amount of waste solution is preferably used.

Water washing process is, in general, carried out after the processing having the fixing ability. A simple processing method can be employed such that stabilization process is conducted without substantial water washing after processing with the processing solution having the fixing ability.

The replenishing rate in the water washing process or the stabilization process is from 3 to 50 times, preferably from 3 to 30 times, and more preferably from 3 to 10 times, per unit area of the photographic material of the carryover from the prebath thereof. In the case of carrying out stabilization processing after water washing, the method of the present invention is effective in a processing system in which the replenishing rate in the final stabilization processing is at least from 3 to 50 times the carryover from the prebath. The replenishment may be carried out continuously or intermittently. The solution which has been used in the water washing and/or the stabilization processes can further be used in the prebath thereof. One such example is that the amount of the water washing tank is reduced by a multistage countercurrent system and the overflow of the water washing tank is introduced into the preceding bleach-fixing tank, and a concentrated solution is fed to the bleach-fixing tank for replenishment to thereby reduce the amount of waste solution.

The amount of washing water used in the water washing process can be selected within a wide range depending on the characteristics (for example, the materials employed, such as couplers) and applications of the photographic material, the temperature of washing water, the number of water washing tanks (the number of water washing stages), the replenishment system, that is, whether a countercurrent system is used or a concurrent system is used, and other various factors. In general, the number of stages in a multistage countercurrent system is preferably from 2 to 6, and particularly preferably from 2 to 4.

The amount of washing water can be greatly reduced using a multistage countercurrent system and washing can be achieved with 0.5 to 1 liter of water per $m^2$ of a photographic material. However, bacteria proliferate due to the increased residence time of the water in the tanks and problems arise such that suspended matter formed adheres to the photographic material. The method in which the calcium and magnesium concentrations are reduced as disclosed in JP-A-62-288838 can be very effectively utilized as a means of overcoming these sorts of problems.

In addition, it is preferred to use the water sterilized by halogen, an ultraviolet germicidal lamp, or an ozonator.

It is also preferred for washing water and a stabilizing solution to contain various antibacterial agents or antimolds for inhibiting the generation of scale or the generation of mold over the processed photographic materials. Examples of such antibacterial agents and antimolds include thiazolylbenzimidazole based compounds disclosed in JP-A-57-157244 and JP-A-58-105145, isothiazolone based compounds disclosed in JP-A-57-8542, chlorophenol based compounds represented by trichlorophenol, bromophenol based compounds, organotin compounds, organozinc compounds, acid amide based compounds, diazine based compounds, triazine based compounds, thiourea based compounds, benzotriazole based compounds, alkylguanidine compounds, quaternary ammonium salts represented by benzalconium chloride, antibiotics represented by penicillin, and general purpose antimolds disclosed in *J. Antibact. Antifung. Agents*, Vol. 1, No. 5, pp. 207 to 223 (1983), Hiroshi Horiguchi, *Bohkin Bohbai no Kagaku* (*Antibacterial and Antifungal Chemistry*), published by Sankyo Shuppan K. K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986). They may be used in combination of two or more. Further, the various fungicides disclosed in JP-A-48-83820 may also be used.

It is preferred for a washing water and a stabilizing solution to contain various surfactants to prevent water marks during drying the processed photographic materials. Examples of such a surfactant include polyethylene glycol type nonionic surfactants, polyhydric alcohol type nonionic surfactants, alkylbenzenesulfonate type anionic surfactants, higher alcohol sulfate type anionic surfactants, alkylnaphthalenesulfonate type anionic surfactants, quaternary ammonium salt type cationic surfactants, amine salt type cationic surfactants, amino salt type amphoteric surfactants, and betaine type amphoteric surfactants. Nonionic surfactants are preferably used and ethylene oxide addition product of alkylphenol is particularly preferred. Octyl-, nonyl-, dodecyl-, and dinonylphenol are particularly preferred as the alkylphenol and the addition mol number of the ethylene oxide is particularly preferably from 8 to 14. Further, it is preferred to use silicone based surfactants having a high defoaming effect.

Also, it is preferred to include various kinds of chelating agents in a washing water and a stabilizing solution. Preferred chelating agents include aminopolycarboxylic acid, e.g., ethylenediaminetetraacetic acid and diethylenetriaminepentaacetic acid, organic phosphonic acid, e.g., 1-hydroxyethylidene-1,1-diphosphonic acid, ethylenediaminetetraacetic acid, and diethylenetriamine-N,N,N',N'-tetramethylenephosphonic acid, and a hydrolysis product of a maleic anhydride polymer disclosed in EP-A-345172, and the like.

A stabilizing solution contains color image stabilizing compounds, for example, formalin, hexamethylenetetramine and derivatives thereof, hexahydrotriazine and derivatives thereof, dimethylolurea, N-methylol compounds such as N-methylolpyrazole, organic acids and pH buffers. The preferred addition amount of these compounds is from 0.001 to 0.02 mol per liter of the stabilizing solution, but the lower the concentration of the free formaldehyde in the stabilizing solution, the less is the splashing of the formaldehyde gas, and is preferred. From these points, hexamethylenetetramine, N-methylolazoles such as N-methylolpyrazole disclosed in JP-A-5-34889, and azolylmethylamine such as N,N'-bis(1,2,4-triazol-1-yl)piperazine, etc., disclosed in JP-A-4-313753 are preferred as color image stabilizers. Further, it is preferred to include various compounds in the stabilizing solution, if necessary, for example, ammonium compounds such as ammonium chloride and ammonium sulfite, metallic compounds such as Bi and Al, a brightening agent, a hardening agent, alkanolamine disclosed in U.S. Pat. No. 4,786,583, and preservatives which can be included in the above-described fixing solution and bleach-fixing solution. For example, sulfinic acid compounds as disclosed in JP-A-1-231051 (benzenesulfinic acid, toluenesulfinic acid, or sodium salt and potassium salt of them) are preferred of them. The addition amount of these compounds is preferably from $1\times10^{-5}$ to $1\times10^{-3}$ mol, and particularly preferably from $3\times10^{-5}$ to $5\times10^{-4}$ mol, per liter of the stabilizing solution.

The replenishing rate in the water washing process or the stabilization process is from 50 to 2,000 ml, and preferably from 100 to 1,000 ml, per $m^2$ of the photographic material.

The method of reverse osmosis processing using a reverse osmosis membrane as disclosed in JP-A-3-55542 can be effectively utilized to reduce the replenishing rate without impairing the stability of color images.

Processing a washing water and/or a stabilizing solution with a reverse osmosis membrane means that the solution in at least one of the tanks comprising the water washing process and/or stabilizing process is allowed to contact the reverse osmosis membrane and the solution which permeated the reverse osmosis membrane is returned to a tank comprising the water washing and/or stabilizing processes.

The water washing process and/or stabilizing process in the multistage countercurrent system preferably comprise(s) from 2 to 6 tanks, more preferably from 3 to 5 tanks, and most preferably from 4 to 5 tanks. All of these tanks may be water washing tanks or all of them may be stabilizing tanks.

When the water washing process and/or stabilizing process in the multistage countercurrent system comprise(s) three or more tanks, a tank to be installed with a reverse osmosis membrane is preferably the second or after and next to the last tank. In this case, it is preferred that the permeated solution which passed through the reverse osmosis membrane and purified is returned to the tank positioned after the tank installed with the reverse osmosis membrane, and the concentrated solution is returned to the tank installed with the reverse osmosis membrane.

The case in which the water washing process and/or stabilizing process in the multistage countercurrent system comprise(s) four or more tanks, and the reverse osmosis membrane is installed in the third or after tank is particularly preferred in the present invention.

There are a high pressure reverse osmosis membrane, a middle pressure reverse osmosis membrane, and a low pressure reverse osmosis membrane as a reverse osmosis membrane, and the use of a low pressure reverse osmosis membrane is preferred in the present invention.

Specifically, when an aqueous solution containing 2,000 ppm of NaCl is processed with a reverse osmosis membrane at 25° C. and a pressure of 5 $kg/cm^2$, a reverse osmosis membrane having the removal rate of NaCl in the permeated solution of from 30 to 90% is preferred. With such a loose reverse osmosis membrane, a large amount of solution can be permeated even at low pressure, and EDTA-Fe which is a cause of generation of stain can be sufficiently removed.

These reverse osmosis membranes comprise a skin layer which controls a solution permeating amount, a removal rate and s membrane performance, and a supporting layer which supports a skin layer, and there are an asymmetrical membrane in which two layers comprise the same material and a complex membrane in which two layers comprise different materials.

A synthetic complex membrane is preferably used in view of a removal rate, a solution permeating amount and durability against EDTA-Fe.

The details about a synthetic complex membrane are disclosed in "Development and Practical Use of High Separation Technique", a separate volume of *Kagaku Kogyo* (Chemical Industry) 29-7, pages 156 to 172, published by Kagaku Kogyo.

There are DRA-40, DRA-80 and DRA-89, products of Daicel Chemical Industries Ltd., and SU-200, SU-210 and SU-220, products of Toray Industries Inc., as specific examples of synthetic complex membranes.

The solution feed pressure applied to a processing solution fed to a reverse osmosis membrane is preferably from 2 to 20 $kg/cm^2$, more preferably from 3 to 15 $kg/cm^2$, still more preferably from 3 to 10 $kg/cm^2$, and most preferably from 3 to 6 $kg/cm^2$.

when a permeation solution feed amount (the amount of the solution which is permeated through a reverse osmosis membrane, purified, and fed to the processing tank positioned after the tank installed with the reverse osmosis membrane) is taken as F, a concentrated solution amount (the amount of the solution which is concentrated by a reverse osmosis membrane and returned to the tank installed with the reverse osmosis membrane) as C, and a fresh replenisher amount as R, a permeation solution feed amount F is preferably more than a fresh replenisher amount R, more preferably F is from 2 to 200 times of R, still more preferably from 5 to 150 times, and particularly preferably from 10 to 100 times. Further, a concentrated solution amount C is preferably more than a permeation solution feed amount F, more preferably C is from 2 to 100 times of F, still more preferably from 3 to 50 times, and particularly preferably from 5 to 30 times. Here, flowing amounts of F, C and R are each a flowing amount per one day.

In a method in which the reverse osmosis process is carried out using a reverse osmosis membrane, the replenishing rate in the water washing or stabilization process may be 200 ml or less, preferably from 30 to 200 ml, and more preferably from 50 to 150 ml, per m2 of the photographic material. The pH of the washing water and stabilizing solution is generally from 4 to 10 but is preferably from 6 to 9. The temperature of the washing water and stabilizing solution is preferably from 30° to 45° C.

The processing time is generally from 10 seconds to 2 minutes, and particularly preferably from 10 to 60 seconds.

It is preferred to use various methods of regeneration in combination to further reduce the above described amounts of replenishers for environmental protection. Regeneration may processing carried out while a processing solution is circulating in an automatic processor, or a processing solution may be once removed from an automatic processor and undergone an appropriate regeneration treatment and then returned to a processing tank as a replenisher.

In particular, a developing solution can be regenerated and reused.

Regeneration of a used developing solution is carried out by anion exchange resins or electrodialysis, or by adding treatment chemicals called regenerants to raise the activity of the developing solution, and the treated solution is reused as a processing solution. In this case, a regeneration rate (a rate of an overflow solution in a replenisher) is preferably 50% or more, particularly preferably 70% or more.

As a process employing a developing solution regeneration, there is a process in which an overflow solution of a developing solution is regenerated and reused as a replenisher. Anion exchange resins are preferably used for regeneration. With respect to particularly preferred compositions of anion exchange resins and the regeneration method of the resins, *Diaion Manual* (I), 14th Ed., 1986, published by Mitsubishi Kasei Corp. can be referred to. The resins having the compositions disclosed in JP-A-2-952 and JP-A-1-281152 are preferably used in the present invention.

A method in which regeneration is carried out by only adding regenerants to an overflow solution to recover a replenisher and not treating with anion exchange resins or electrodialysis as disclosed in JP-A-3-174154 is most preferred for simplicity.

As metal chelate bleaching agents in a bleaching solution and/or a bleach-fixing solution are reduced as a bleaching process progresses, it is preferred to subject a bleaching solution and/or a bleach-fixing solution to a continuous regenerating treatment in cooperation with the bleaching and/or bleach-fixing process(es). Specifically, it is preferred to blow air to a bleaching solution and/or a bleach-fixing solution by an air pump to reoxidize the reduced metal chelate with oxygen, that is, aeration. Regeneration can also be achieved by the addition of oxidizing agents such as hydrogen peroxide, persulfate and bromate.

Regeneration of a fixing solution and a bleach-fixing solution is conducted by electrolytic reduction of accumulated silver ions. Removal of accumulated halogen ions with anion exchange resins is preferred for maintaining a fixing ability as well.

The method disclosed in EP-A-479262 in which only regenerants are added to an overflow solution to thereby obtain a replenisher without aeration or removal of silver ions by anion exchange resins is the most preferred regeneration method of a bleach-fixing solution for its simplicity.

Silver recovery from a processing solution having the fixing ability can be carried out according to known methods, and the regenerated solution after the silver recovery can be used in the present invention. Preferred methods of the silver recovery include an electrolysis method (disclosed in French Patent 2,299,667), a precipitation method (disclosed in JP-A-52-73037 and German Patent 2,331,220), an ion exchange method (disclosed in JP-A-51-17114 and German Patent 2,548,237), and a metal substitution method (disclosed in British Patent 1,353,805). It is preferred to conduct these silver recovery methods by an in-line system from the solution in a tank to further improve the rapid processability.

The present invention is applicable to processing of color reversal photographic materials. In such a case, the following processing steps are conducted prior to the color development.

(1) Black-and-white development—water washing—reversal exposure—color development (2) Black-and-white development—water washing—reversal processing—color development (3) Black-and-white development—water washing—color development In the case of (3), it is preferred that a fogging agent for reversal processing is previously included in a color developing solution. The compounds and processing conditions disclosed in JP-A-3-71130, last line, right lower column, page 14 to line 3, right upper column, page 16 can be applied to each process of color reversal processing. Hydroxylamines having substituents described above at the part of the color developing solution are preferably used in a black-and-white developing solution.

The processing of the present invention is carried out using an automatic processor. Automatic processors which are preferably used in the present invention are described below.

It is preferred that the contact area of air with the processing solution in a processing tank and a replenisher tank (open area) of the present invention is as small as possible. For example, when the open factor is represented by the equation dividing the open area ($cm^2$) by the volume of the processing solution in the tank ($cm^3$), the open factor is preferably 0.01 ($cm^{-1}$) or less, more preferably 0.005 or less, and particularly preferably 0.001 or less.

It is preferred to provide a solid or liquid non-contact means with air which is floating on the surface of the solution in a processing tank or a replenisher tank to reduce the open area.

Specifically, means of covering the surface of the solution with a floating lid of plastics or shielding with a liquid immiscible with and not chemically reacting with a processing solution are preferred. Liquid paraffin and liquid saturated hydrocarbon are preferred examples of such liquids.

The crossover time required for a photographic material to transfer from one processing tank to another processing tank in the air is preferred to be as short as possible for carrying out processing rapidly, preferably 10 seconds or less, more preferably 7 seconds or less, and most preferably 5 seconds or less. The use of a cinema type automatic processor is preferred in the present invention for achieving such a short crossover time, in particular, a leader conveyance system is preferred. Such a system is adopted in an automatic processor FP-560B, a product of Fuji Photo Film Co., Ltd.

A belt conveyor system disclosed in JP-A-60-191257, JP-A-60-191258 and JP-A-60-191259 is preferred as a conveying system of a leader or a photographic material, in particular, the systems disclosed in JP-A-3-126944, JP-A-3-127062 and JP-A-3-127061 are preferably adopted as conveyor structures.

The structure of a crossover rack which is provided with a mixture inhibiting plate disclosed in JP-A-3-126943 is preferred for use in the present invention for shortening the crossover time and inhibiting the mixture of the processing solutions.

It is preferred in the present invention that the amounts corresponding to the evaporated processing solutions be supplemented with water, that is, a so-called evaporation compensation, and it is particularly preferred with regard to a color developing solution, a bleaching solution and a bleach-fixing solution.

There is no particular limitation on the method of supplementing water, but the following methods are preferred of all, e.g., a method in which a monitoring water tank is arranged separately from the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method in which a liquid level sensor or an overflow sensor is used to compensate for the evaporated amount of water, which is disclosed in JP-A-3-248155, JP-A-3-249644, JP-A-3-249645, JP-A-3-249646 and JP-A-4-14042. The most preferred evaporation compensation method is a method in which the presumed amount of water corresponding to the evaporation amount calculated from the coefficient previously determined based on the information of operating time, stopping time and temperature controlling time of the automatic processor is added, which is disclosed in *Nippon Hatsumei Kyokai Kokai Giho,* 94-49925, line 26, right column, page 1 to line 28, left column, page 3, and JP-A-4-1756.

Further, means to reduce the evaporation amount are necessary, for example, reducing the open area or controlling the air capacity of an exhaust fan are required. As the preferred open factor of a color developing solution is as described above, it is preferred to reduce open areas with respect to other processing solutions as well.

As a means to reduce the evaporation amount, "maintaining the humidity of the upper space of the processing tank at 80% RH or more" as disclosed in JP-A-6-110171 is particularly preferred, and it is preferred to be provided with the automatic washer for the evaporation preventing rack and roller illustrated in FIGS. 1 and 2.

An exhaust fan is provided for preventing the dew condensation during temperature controlling, and the preferred displacement is from 0.1 $m^3$ to 1 $m^3$, particularly preferably from 0.2 $m^3$ to 0.4 $m^3$, per minute.

Drying conditions of photographic materials also affect the evaporation of processing solutions. The use of a hot air heater made of ceramic is a preferred drying system, and the supplying air capacity is preferably from 4 $m^3$ to 20 $m^3$, and particularly preferably from 6 $m^3$ to 10 $m^3$, per minute.

A superheating preventing thermostat of a hot air heater made of ceramic is preferably a system actuated by heat transfer and is preferably installed on the leeward side or on the Windward side through the radiation fin or the heat transfer part. Drying temperature is preferred to be controlled according to the water content of the photographic material to be processed, and optimal temperature ranges are from 45° to 55° C. in the case of a 35 mm width film and from 55° to 65° C. in the case of a Brownie film.

As a replenishing pump is used in the replenishment of processing solutions, a bellows type replenishing pump is preferred. As a method of improving the accuracy of replenishment, making the diameter of a liquid pipe to a replenishing nozzle smaller is effective to prevent the backflow at stopping time. The inside diameter is preferably from 1 to 8 mm, and particularly preferably from 2 to 5 mm.

There are used various materials of parts in an automatic processor, and preferred materials are described below.

Modified PPO (modified polyphenylene oxide) and modified PPE (modified polyphenylene ether) resins are preferred as materials of tanks such as a processing tank and a temperature controlling tank. An example of modified PPO includes "Noryl", a product of Nippon G. E. Plastics, and examples of modified PPE include "Zailon", a product of Asahi Chemical Industry Co., Ltd. and "Yupiace", a product of Mitsubishi Gas Chemical Co., Inc. Further, these materials are suitable for parts which might contact with processing solutions, such as a processing rack or a crossover.

PVC (polyvinyl chloride), PP (polypropylene), PE (polyethylene) and TPX (polymethylpentene) resins are suitable as materials for rollers of processing parts. In addition, these materials are usable for other parts which might contact with processing solutions. PE resin is also preferred as a material for a replenisher tank made by blow molding.

PA (polyamide), PBT (polybutylene terephthalate), UHMPE (ultrahigh molecular weight polyethylene), PPS (polyphenylene sulfide), LCP (totally aromatic polyester resin, liquid crystal polymer) resins are preferred as materials for processing parts, gears, sprockets and bearings.

PA resin is a polyamide resin such as 66 nylon, 12 nylon and 6 nylon, and those containing glass fibers and carbon fibers are fast to swelling by processing solutions and which are usable.

A high molecular weight product such as MC nylon and a compression molded product are usable without fiber reinforcement. A UHMPE resin is preferably not reinforced, and preferred and commercially available products thereof include "Lubmer", "Hizex Million", Mitsui Petrochemical Industries, Ltd., "New Light", Sakushin Kogyo Co., Ltd., and "Sunfine", Asahi Chemical Industry Co., Ltd. The molecular weight is preferably 1,000,000 or more, and more preferably from 1,000,000 to 5,000,000.

The preferred PPS resins are those reinforced with glass fibers or carbon fibers. Examples of commercially available LCP resins include "Victrex", a product of ICI Japan Co., Ltd., "Ekonol", Sumitomo Chemical Co., Ltd., "Zaider", Nippon Oil Co., Ltd., and "Vectra", Polyplastics Co., Ltd.

Ultrahigh tenacity polyethylene fibers or polyvinylidene fluoride resins described in JP-A-4-151656 are preferred as materials of a conveyor belt.

Vinyl chloride foam resins, silicone foam resins and urethane foam resins are preferred as flexible materials for squeegee rollers and the like. An example of urethane foam resin includes "Lubicel", a product of Toyo Polymer Co., Ltd.

EPDM rubber, silicone rubber and biton rubber are preferred as rubber materials for couplings of piping, couplings of agitation jet pipe and sealing materials.

Drying time is preferably from 30 seconds to 2 minutes and particularly from 40 seconds to 80 seconds.

Continuous processing primarily by a replenishment system has been described hitherto, however, a batch system in which processing is carried out with a fixed amount of a processing solution without replenishing, subsequently processing is carried out again by replacing the entire or a partial processing solution with a new processing solution can also preferably be used in the present invention.

The processing chemicals which can be used in the present invention may be supplied in the form of one part type or may be supplied in the form of a plural part type concentrated solutions, and they may be dusting powders, tablets, granulated powders or paste. Further, they may be supplied in the form of a solution immediately usable as it is, or arbitrary combinations of concentrated solutions, dusting powders, tablets, granulated powders, paste and a working solution.

When the processing chemicals to be used are in the form of one part type concentrated solution, it is diluted and used as a replenisher. In such a case, it is preferred that the concentrated solution is set in the automatic processor and automatically diluted with water in the replenisher tank. It is preferred that the water to be used for dilution is the water in the washing water replenisher tank. Alternatively, a concentrated solution may be directly supplied to a processing tank as it is and the water corresponding to the diluting rate may be directly added to the processing tank. This method is suitable for a compact processor not having a replenisher tank.

The method is the same with a plural part type concentrated solutions. It is preferred that the concentrated solutions are set in the automatic processor and automatically diluted with water in the replenisher tank. The water in the washing water replenisher tank is preferably used as the water for dilution. Further, each part of the concentrated solutions may be directly supplied to a processing tank as they are and the water corresponding to the diluting rate may be directly added to the processing tank.

The method is also the same in the case of the processing chemicals in the form of dusting powders, tablets, granulated powders or paste. It is preferred that the chemicals are directly added to the processing tank and the water corresponding to the diluting rate may be directly added to the processing tank. Moreover, it is also preferred that they are automatically dissolved and diluted in the replenisher tank and used as a replenisher.

The materials of the replenisher cartridge for use in the present invention may be any of paper, plastics, metals and the like, but plastic materials having an oxygen permeation coefficient of 50 ml/m$^2$.atm.day or less are particularly preferred. Further, an oxygen permeation coefficient can be calculated according to the method disclosed in *$O_2$ Permeation of Plastic Container, Modern Packing*, N.J., Calyan, December, 1968, pages 143 to 145.

Specific examples of preferred plastic materials include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET).

The use of PVDC, NY, PE, EVA, EVAL and PET is preferred in the present invention for the purpose of reducing oxygen permeability.

These materials may be used alone, molded, or several sheets may be laminated (so-called laminated film). The shape of a vessel may be a bottle type, a cubic type, or a pillow type, but a cubic type or a corresponding structure is particularly preferred in the present invention which is flexible, handleable and the volume can be reduced after use.

When these materials are used in the form of a laminated film, the following structures are particularly preferred but the present invention is not limited thereto. PE/EVAL/PE, PE/aluminum foil/PE, NY/PE/NY, NY/PE/EVAL, PE/NY/PE/WVAL/PE, PE/NY/PE/PE/PE/NY/PE, PE/$SiO_2$ film/PE, PE/PVDC/PE, PE/NY/aluminum foil/PE, PE/PP/aluminum foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminum foil/PE, paper/aluminum foil/PE, paper/PE/aluminum foil/PE, PE/PVDC/NY/PE, NY/PE/aluminum foil/PE, PET/EVAL/PE, PET/aluminum foil/PE, PET/aluminum foil/PET/PE.

The thickness of the above laminated film is from about 5 to 1,500 μm, and preferably from about 10 to 1,000 μm. The volume of the finished vessel is from about 100 ml to 20 liters, and preferably from about 500 ml to 10 liters.

The above vessel (cartridge) may have a case of corrugated cardboard or plastics or may be molded integrally with the case.

The cartridge of the present invention can be charged with various processing solutions, for example, a color developing solution, a black-and-white developing solution, a bleaching solution, a compensating solution, a reversal solution, a fixing solution, a bleach-fixing solution, and a stabilizing solution. Particularly, a cartridge having a low oxygen permeation coefficient is suitable for the use of a color developing solution, a black-and-white developing solution, a fixing solution and a bleach-fixing solution.

Conventionally used rigid vessels for processing solutions of a monolayer material such as high density polyethylene (HDPE), polyvinyl chloride resin (PVC), and polyethylene terephthalate (PET) and a multilayer material such as nylon/polyethylene (NY/PE) can be used.

A flexible vessel for processing solutions the volume of which can be reduced after the content is discharged and empty, that is, the required space can be reduced, can also be used.

It is preferred to use the above flexible vessel in the present invention. One specific example of the above flexible vessel is a vessel for a solution comprising a flexible vessel body which is opened and closed by a cap member matching a hard opening part protruding upward from the vessel body, the vessel body and the opening part are integral-molded and at least one part of the vessel body toward the height direction has a bellows part (FIG. 1 and FIG. 2 disclosed in JP-A-7-5670).

A flexible vessel having a bellows part is described below.

The shape of the vessel is a structure which has a bellows part and a horizontal cross section is a nearly square type (FIG. 1 in JP-A-7-5670), a nearly hexagonal type, a nearly octagonal type, a nearly round type (FIG. 2 in JP-A-7-5670), or an oval type.

A nearly square type or a nearly hexagonal type is preferred to reduce the required space under the conditions charged with the content. With respect to the bellows part (concave and convex parts), the number of the convex parts is preferably from 2 to 20, more preferably from 3 to 10, and particularly preferably from 4 to 8.

There is no particular limitation on the degree of concave and convex parts, but the outer circumferential dimension of the concave part is 85% or less, preferably from 40 to 75%, and more preferably from 50 to 75%, based on the outer circumferential dimension of the convex part.

The ratio of the total height of the vessel body after the bellows part is completely compressed to the total height of the vessel body before the bellows part is compressed is preferably 50% or less, more preferably 40% or less and particularly preferably from 10 to 30%. It is preferred to design and manufacture so that this ratio be 10% or more.

It is possible to impart to the above vessel a necessary gas barrier ability by changing materials and raw materials to be used. For example, when a high oxygen barrier ability is necessary such as a developing solution, a gas barrier ability of 25 ml/m$^2$.day.atm (20° C., 65%) or less, preferably from 0.5 to 10 ml/m$^2$.day.atm (20° C., 65%) can be obtained by molding the vessel using a multilayer structure comprising a low density polyethylene as a major component such as a three-layer structure of low density polyethylene/ polyvinyl alcohol-ethylene copolymer/low density polyethylene (LDPE/EVOH/LDPE) or a layer structure of low density polyethylene/nylon (LDPE/NY).

When an oxygen barrier ability is not necessarily required, as for a bleaching solution, for example, it is possible to mold the vessel using a low density polyethylene (LDPE) alone or ethylene-vinyl acetate copolymer (EVA). The low density polyethylene which can be used include a low density polyethylene having a density of 0.940 g/cc or less, preferably from 0.90 to 0.94 g/cc, and more preferably from 0.905 to 0.925 g/cc. In this case, the obtained gas barrier ability can be made to be 50 ml/m$^2$.day.atm (20° C., 65%) or more, for example, from 100 to 5,000 ml/m$^2$.day.atm (20° C., 65%).

The vessel is molded so that the average thickness of the opening part of the vessel, flange part and the vicinities of these parts becomes preferably from 1 to 4 mm, more preferably from 1 to 3 mm, and particularly preferably from 1.2 to 2.5 mm, so that the thickness of the vessel body becomes preferably from 0.1 to 1.5 mm, more preferably from 0.2 to 1.0 mm, and particularly preferably from 0.3 to 0.7 mm, and so that the difference between both becomes preferably 0.2 mm, and more preferably about 0.5 mm.

The ratio of the surface area of the vessel (cm$^2$) to the content volume of the vessel (cm$^3$) increases according to the structure of the bellows part, but is preferably from 0.3 to 1.5 cm$^{-}$, more preferably from 0.4 to 1.2 cm$^{-1}$, and particularly preferably from 0.5 to 1.0 cm$^{-1}$.

If the head space (the upper space of the inside of the vessel not containing the processing solution) of the vessel is little, it is preferred from the viewpoint of the stability of the solution when charging the solution to the vessel, but if the head space is too little, the solution is liable to spill during charging or use. The charging rate of the above vessel is preferably from 65 to 95%, and more preferably from 70 to 90%.

The cap or the inner stopper of the above vessel is preferably made of the same material with the vessel body for the purpose of easy selection for recycling for reclaiming. The cap or the inner stopper can be given the necessary gas barrier ability by changing the materials and raw materials thereof in the same manner as the above described vessel body.

There is no limitation about the content volume of the above vessel, but it is preferred from 50 ml to 5 liters from the viewpoint of handleability.

Examples of flexible vessels for processing solutions A to D which have bellows parts are shown below.

| Name of the vessel | Vessel A | Vessel B | Vessel C | Vessel D |
|---|---|---|---|---|
| Shape | Nearly square (Fig. 1) | Nearly round (Fig. 2) | Nearly square (Fig. 1) | Nearly square (Fig. 1) |
| Outer circumference of the convex part of the bellows part (cm) | 24 cm | 24 cm | 35 cm | 35 cm |
| Outer circumference of the concave part of the bellows part (cm) | 16 cm | 16 cm | 24 cm | 24 cm |
| Outer circumference of the concave part/outer circumference of the convex part (%) | 67% | 67% | 67% | 67% |
| Height before the bellows part is compressed (cm) | 18 cm | 18 cm | 31 cm | 35 cm |
| Height after the bellows part is compressed (cm) | 4 cm | 4 cm | 7 cm | 8 cm |
| Reduction rate of the height by the compression of the bellows part (%) | 22% | 22% | 23% | 23% |
| Content volume (ml) | 580 ml | 580 ml | 2,300 ml | 2,900 ml |
| Charge volume (ml) | 500 ml | 500 ml | 2,000 ml | 2,500 ml |
| Rate of charge (%) | 86% | 86% | 86% | 86% |
| Material of the vessel body | LDPE (density: 0.91 g/cc) | LDPE (density: 0.91 g/cc)/NY/LDPE (density: 0.91 g/cc) | LDPE (density: 0.91 g/cc) | LDPE (density: 0.91 g/cc)/NY/LDPE (density: 0.91 g/cc) |
| Material of cap and inner stopper | LDPE (density: 0.91 g/cc) | LDPE (density: 0.91 g/cc)/NY/LDPE (density: 0.91 g/cc) | LDPE (density: 0.91 g/cc) | LDPE (density: 0.91 g/cc)/NY/LDPE (density: 0.91 g/cc) |
| Oxygen permeability (ml/m$^2$ · day · atm (20° C., 65%)) | 100 | 1.0 | 80 | 0.9 |
| Thickness of the vessel body (mm) | 0.5 mm | 0.5 mm | 0.7 mm | 0.6 mm |
| Surface area of the vessel body (cm$^2$) | 520 cm$^2$ | 505 cm$^2$ | 1,900 cm$^2$ | 1,940 cm$^2$ |

The present invention is applicable to any photographic materials. Preferred examples of silver halide emulsions and other substances (additives or the like) for use in the present invention, photographic constitutional layers (arrangement of the layers or the like), and processing methods for processing the photographic materials and additives for processing are disclosed in the patent publications described below, and those disclosed in EP-A-355660 JP-A-2-139544 are particularly preferably used.

TABLE 8

| Photographic Constitutional Element | JP-A-62-215272 | JP-A-2-33144 | EP-A-355660 |
|---|---|---|---|
| Silver Halide Emulsion | p. 10, right upper column, l 6 to p. 12, left lower column, l. 5, p. 12, right lower column, 4 line up from the bottom to p. 13, left upper column, l. 17 | p. 28, right upper column, l. 16 to p. 29, right lower column, l. 11 p. 30, ll 2 to 5 | p. 45, l 53 to p. 47, l. 3 p. 47, ll. 20 to 22 |
| Silver Halide Solvent | p. 12, left lower column, ll. 6 to 14 p. 13, left upper column, 3 line up from the bottom to p. 18, left lower column, last line | — | — |
| Chemical Sensitizer | p. 12, left lower column, 3 line up from the bottom to right lower column, | p. 29, right lower column, l. 12 to last line | p. 47, ll. 4 to 9 |

TABLE 8-continued

| Photographic Constitutional Element | JP-A-62-215272 | JP-A-2-33144 | EP-A-355660 |
|---|---|---|---|
| | 5 line up from the bottom p. 18, right lower column, l. 1 to p. 22, right upper column, 9 line up from the bottom | | |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |
| Emulsion Stabilizer | p. 39, left upper column, l. 1 to p. 72, right upper column, last line | p. 30, left upper column, l. 14 to right upper column, l. 1 | p. 47, l. 16 to 19 |
| Development Accelerator | p. 72, left lower column, l. 1 to p. 91, right upper column, l. 3 | — | — |

TABLE 9

| Photographic Constitutional Element | JP-A-62-215272 | JP-A-2-33144 | EP-A-355660 |
|---|---|---|---|
| Color Coupler (cyan, magenta, yellow) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45, ll. 29 to 31<br>p. 47, l. 23 to p. 63 l. 50 |
| Color Intensifier | p. 121, left upper column, l. 7 to p. 125, right upper column, l. 1 | — | — |
| Ultraviolet Absorber | p. 125, right upper column, l. 2 to p. 127, left lower column, last line | p. 37, right lower column, l. 14 to p. 38, left upper column, l. 11 | p. 65, ll. 22 to 31 |
| Discoloration Inhibitor (image stabilizer) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvents | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additive | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |

TABLE 10

| Photographic Constitutional Element | JP-A-62-215272 | JP-A-2-33144 | EP-A-355660 |
|---|---|---|---|
| Antistaining Agent | p. 188, right lower column, l. 9 to p. 193, right lower column, l. 10 | p. 37, left upper column, last line to right lower column, l. 13 | p. 65, l. 32 to p. 66, l. 17 |
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventing | p. 210, left lower column, l. 1 to p. 222, left lower column, l. 5 | p. 25, left upper column, l. 1 to p. 27, right lower column, l. 9 | — |

TABLE 10-continued

| Photographic Constitutional Element | JP-A-62-215272 | JP-A-2-33144 | EP-A-355660 |
|---|---|---|---|
| agent) | | | |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, l. 3 to p. 230, left upper column, l. 1 | — | — |

TABLE 11

| Photographic Constitutional Element | JP-A-62-215272 | JP-A-2-33144 | EP-A-355660 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column, l. 3 | p. 66, l. 29 to p. 67, l. 13 |
| Layer Composition of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, ll. 1 to 15 column, l. 7 | p. 66, ll. 18 to 22 |
| Color Mixture Preventative | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |

TABLE 12

| Photographic Constitutional Element | JP-A-62-215272 | JP-A-2-33144 | EP-A-355660 |
|---|---|---|---|
| Polymer Latex | p. 230, left upper column, l. 2 to p. 239, last line | — | — |
| Matting Agent | p. 240, left upper column, l. 1 to p. 240, right upper column, last line | | |
| Photographic Processing Method (processing step and additive) | p.. 3, right upper column, l. 7 to p. 10, right upper column, l. 5 | p. 39, left upper column, l. 4 to p. 42, left upper column, last line | p. 67, l. 14 to p. 69, l. 28 |

Note) References in the columns of JP-A-62-215272 include contents amended by The Amendment dated March 16, 1987, which appears at the end of the Patent Publication. Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

The use of pyrazolotriazole type magenta couplers is particularly preferred as a magenta coupler. Specific examples of the preferred pyrazolotriazole type magenta couplers are shown below.

M-1
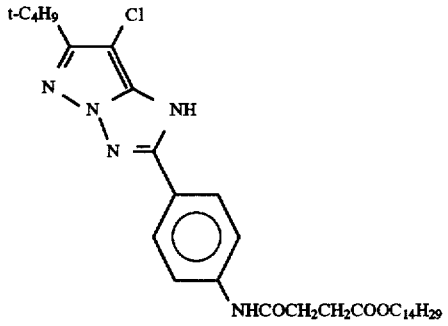
M-2
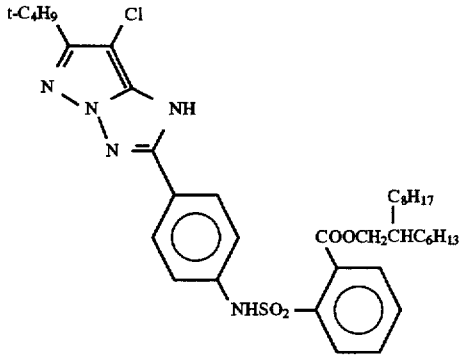
M-3
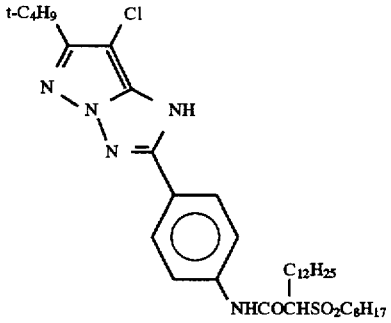
M-4
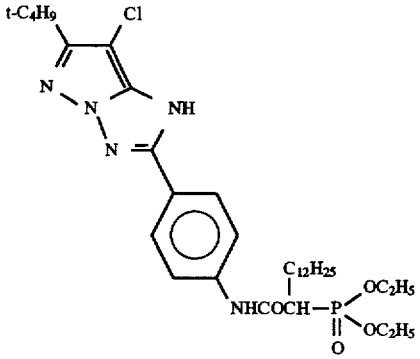

-continued
M-5
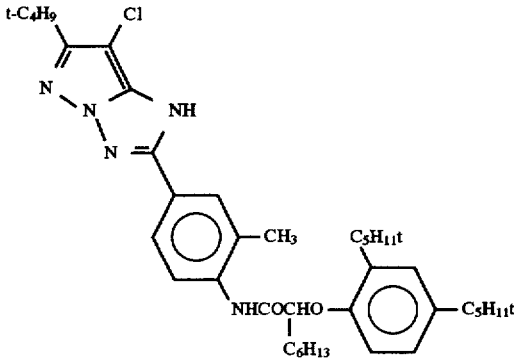
M-6
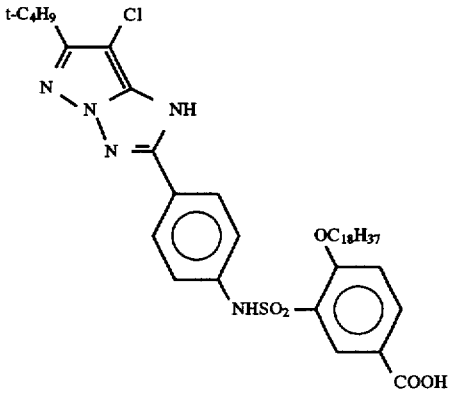
M-7
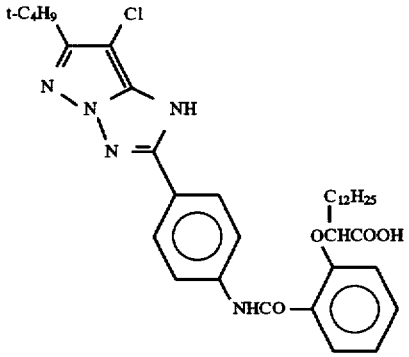
M-8
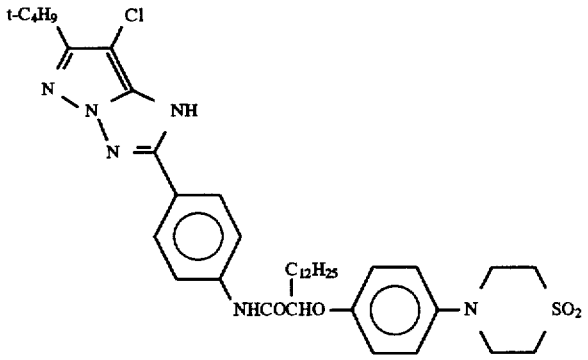

-continued
M-9
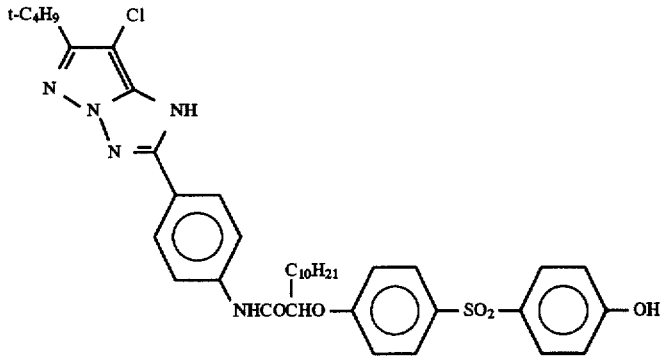
M-10
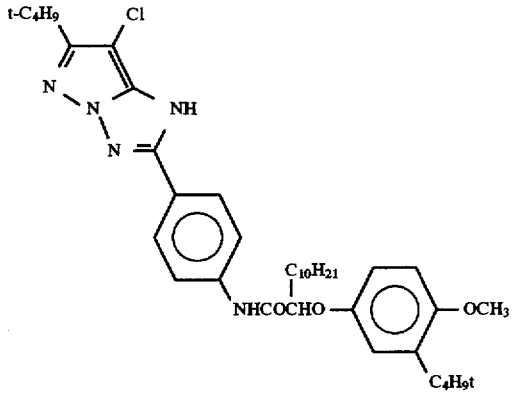
M-11
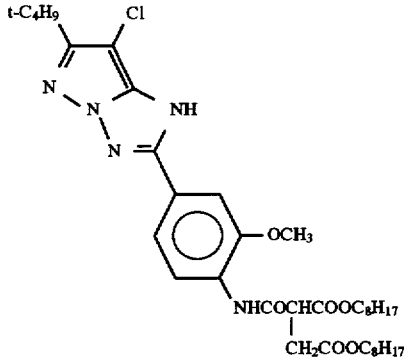
M-12
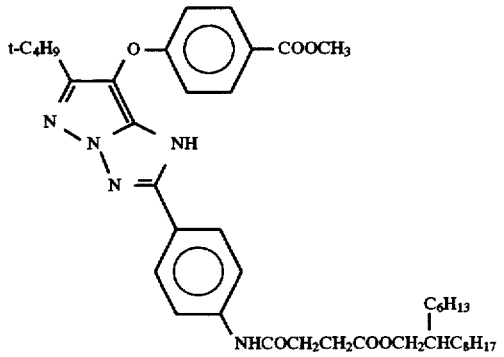

-continued
M-13
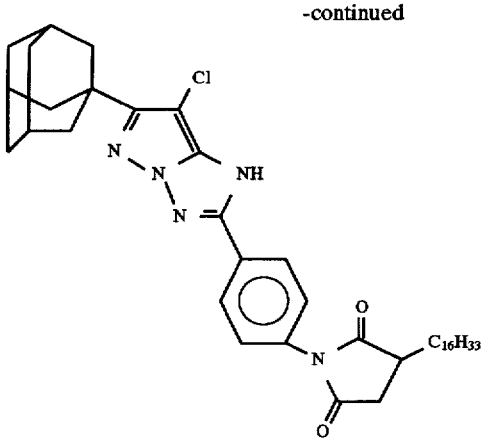
M-14
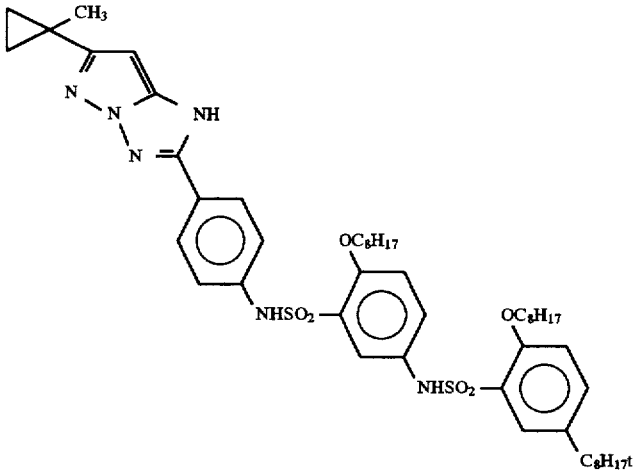
M-15
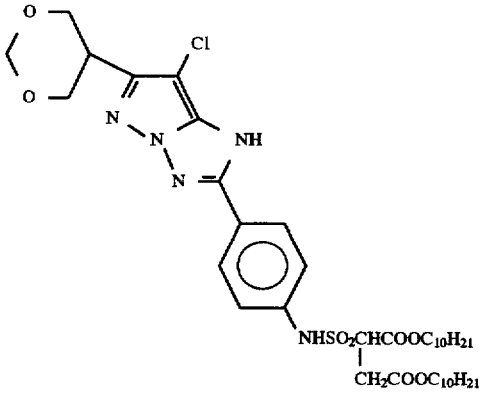
M-16
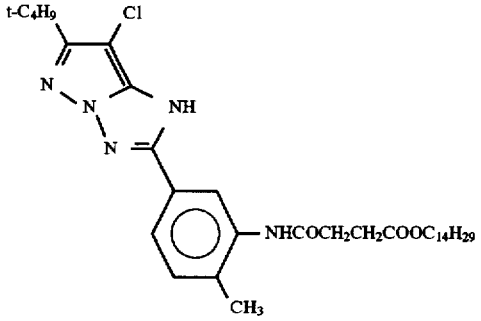
In addition to the diphenylimidazole based cyan couplers disclosed in JP-A-2-33144, the use of the 3-hydroxypyridine based cyan couplers disclosed in EP-A-333185 (above all, Coupler (42), a 4-equivalent coupler is rendered 2-equivalent by having a chlorine releasing group, and Couplers (6) and (9), cited as specific examples, are particularly preferred) and the cyclic active methylene based cyan couplers disclosed in JP-A-64-32260 (above all, Couplers 3,8 and 34 cited as specific examples are particularly preferred) is also preferred as cyan couplers.

The silver halide for use in the present invention includes silver chloride, silver bromide, silver chlorobromide, silver iodochlorobromide and silver iodobromide. However, silver chlorobromide or silver chloride emulsion having a silver chloride content of 90 mol % or more, preferably 95% mol % or more, and more preferably 98 mol % or more, substantially not containing silver iodide, is preferably used for the purpose of rapid processing. As photographic materials which are used in the method of the present invention, it is particularly preferred for a high silver chloride type color photographic material for print (e.g., color paper).

Further, it is preferred for the hydrophilic colloid layer of the photographic material of the present invention to contain a dye capable of decoloring by processing (especially oxonol dyes), disclosed in EP-A-337490, pp. 27 to 76, so as to make the optical reflection density at 680 nm of the photographic material become 0.70 or more, or for the water resistant resin layer of the support to contain 12 wt % or more (more preferably 14 wt % or more) of a titanium oxide surface treated with divalent to tetravalent alcohols (for example, trimethylol ethane or the like), for the purpose of improving sharpness of images.

Further, it is preferred to use the color image storage stability improving compounds as disclosed in EP-A-277589 together with the couplers in the photographic material of the present invention. In particular, use in combination with pyrazoloazole couplers is preferred.

That is, compound (F) which produces a chemically inert and substantially colorless compound by chemical bonding with the aromatic amine based developing agent remaining after color development processing and/or compound (G) which produces a chemically inert and substantially colorless compound by chemical bonding with the oxidation product of the aromatic amine based color developing agent remaining after color development processing are preferably used in combination or individually to effectively prevent generation of stains during storage after processing which is due to formation of a dye by the reaction of a coupler with the color developing agent or its oxidation product remaining in the film, and to prevent other side reactions.

It is preferred for the photographic material for use in the present invention to contain bactericides as disclosed in JP-A-63-271247 to prevent propagation of various mold and bacteria in a hydrophilic colloid layer which deteriorate images.

It is preferred for the photographic layer of the silver halide color photographic material of the present invention to have the degree of swelling of from 1.1 to 3.0 from the viewpoint of improving the adhesive property of the color photographic material after processing. The degree of swelling is more preferably from 2.0 to 3.0.

The degree of swelling in the present invention means the value obtained by dividing the film thickness of the photographic layer after the color photographic material is immersed in distilled water at 33° C. for 2 minutes by the dry film thickness of the photographic layer. The degree of swelling is more preferably from 1.3 to 2.7. The dry film thickness of the photographic layer is preferably from 5 to 25 μm and more preferably from 7 to 20 μm. The dry film thickness of the photographic material for print is preferably from 7 to 10 μm.

Further, herein, the photographic layer means laminated hydrophilic colloid group layer containing at least one light-sensitive silver halide emulsion layer and hydrophilic colloid layers are in water permeable relationship with this silver halide emulsion layer each other. The backing layer provided on the opposite side of the photographic light-sensitive layer side of the support is not included in the photographic layer. The photographic layer comprises, in general, a plurality of layers concerning formation of photographic images and includes an interlayer, a filter layer, an antihalation layer and a protective layer besides the silver halide emulsion layer.

Any methods can be used to control the degree of swelling within the range of the present invention, for example, it can be controlled by changing the amount and the kind of gelatin for use in the photographic film, the amount and the kind of a hardening agent, or changing the drying conditions of the photographic layer after coating or aging conditions. The use of gelatin is preferred for the photographic layer, but other hydrophilic colloids can also be used. Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin can be used as well as lime-processed gelatin, and gelatin hydrolysis products and enzymatic decomposition products of gelatin can also be used. Those which can be obtained by reacting gelatin with, for example, acid halide, acid anhydride, isocyanates, bromoacetic acid, alkanesultones, vinylsulfonamides, maleinimide compounds, polyalkylene oxides, and epoxy compounds can be used as gelatin derivatives.

Those grafted gelatin with homopolymers or copolymers of vinyl monomers such as acrylic acid, methacrylic acid, derivatives thereof such as esters and amides, acrylonitrile, and styrene can be used as graft polymers of gelatin. In particular, graft polymers with polymers compatible with gelatin in a certain degree, e.g., acrylic acid, methacrylic acid, acrylamide, methacrylamide, and hydroxyacrylmethacrylate are preferred. Examples thereof are disclosed in U.S. Pat. No. 2,763,625, 2,831,767 and 2,956,884. Representative synthetic hydrophilic high molecular weight compounds are disclosed, for example, in German Patent Application (OLS) No. 2,312,708, U.S. Pat. Nos. 3,620,751, 3,879,205 and JP-B-43-7561.

The following compounds can be used alone or in combination as a hardening agent, for example, chromium salts (e.g., chrome alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methylenebis [β-(vinylsulfonyl) propionamide]), active halogen compounds (e.g., 2,4-dichloro-6-hydroxy-α-triazine), mucohalogenic acids (e.g., mucochloric acid, mucophenoxychloric acid), isooxazoles, dialdehyde starches, and 2-chloro-6-hydroxytriazinylated gelatin.

Particularly preferred hardening agents are aldehydes, active vinyl compounds and active halogen compounds.

Further, the film swelling rate $T_{1/2}$ of the photographic material of the present invention is preferably 20 seconds or less, and more preferably 10 seconds or less. T½ is defined as the time to reach ½ of the saturated film thickness, taking 90% of the maximum swollen film thickness reached when being processed at 38° C. for 3 minutes and 15 seconds in a color developing solution as the saturated film thickness.

In addition, a white polyester type support, or a support having a layer containing a white pigment provided on the same side as a silver halide emulsion layer side of the support may be used in the photographic material of the present invention for a display. Further, it is preferred to provide an antihalation layer on the same side as the silver halide emulsion layer side of the support or on the back surface thereof for improving sharpness. The transmission density of the support is preferably set in the range of from 0.35 to 0.8 so as to enjoy a display in either of reflected light or transmitted light.

The photographic material of the present invention may be exposed by either visible light or infrared light. An exposure may be either of a low intensity exposure or a high intensity short time exposure, and in the latter case, a laser scanning exposure, whose exposure time per one picture element is shorter than $10^{-4}$ seconds is preferred.

Moreover, it is preferred to use the band-stop filter disclosed in U.S. Pat. No. 4,880,726, by which the color mixture by light is prevented and the color reproduction is conspicuously improved.

The present invention is described in detail with reference to the examples, but it should not be construed as being limited thereto.

EXAMPLE 1

3.3 g of sodium chloride was added to a 3% aqueous solution of lime-processed gelatin, then 3.2 ml of N,N'-dimethylimidazolidine-2-thione (a 1% aqueous solution) was added thereto. After the pH of this solution was adjusted to 3.5, an aqueous solution containing 0.2 mol of silver nitrate and an aqueous solution containing 0.12 mol of sodium chloride and 0.8 mol of potassium bromide were added to the solution with vigorously stirring at 52° C., and mixed. Subsequently, an aqueous solution containing 0.8 mol of silver nitrate and an aqueous solution containing 0.48 mol of sodium chloride, 0.32 mol of potassium bromide and 0.02 mg of potassium hexachloroiridate(IV) were added to the solution with vigorously stirring at 52° C., and mixed. After maintaining the temperature at 52° C. for 5 minutes, the reaction product was subjected to desalting and washing with water, and 90.0 g of lime-processed gelatin was further added thereto. The pH of the obtained emulsion was adjusted to 6.5, Spectral Sensitizing Dye R-1 was added to the emulsion at 54° C., and further sodium thiosulfate and chloroauric acid were added to conduct spectral sensitization, sulfur sensitization and gold sensitization. 150 mg of 1-(3-methylureidophenyl)-5-mercaptotetrazole was added to the emulsion at the time of termination of chemical sensitization for the purpose of stabilization and prevention of fogging. Further, 2.6 g of Compound R-2 was added. The thus obtained silver chlorobromide emulsion (average grain size: 0.53 μm, cubic grains having variation coefficient of grain size distribution of 8%, silver bromide: 40 mol %) was designated Emulsion 101.

Emulsion 102 was prepared in the same manner as the preparation of Emulsion 101, but the temperature at the time of grain formation was changed to obtain an average grain size of 0.45 μm, and the spectral sensitizing dye that was added before chemical sensitization was replaced with Spectral Sensitizing Dye G-1. The thus obtained silver chlorobromide emulsion (average grain size: 0.45 μm, cubic grains having variation coefficient of grain size distribution of 8%, silver bromide: 40 mol %) was designated Emulsion 102. In this case, the addition amount of potassium hexachloroiridate(IV) was 0.032 mg, the addition amount of 1-(3-methylureidophenyl)-5-mercaptotetrazole was 180 mg, and Compound R-2 was not added.

Further, an emulsion was prepared in the same manner as the preparation of Emulsion 101, but the temperature at the time of grain formation was changed to obtain an average grain size of 0.86 μm, and the spectral sensitizing dye that was added before chemical sensitization was replaced with Spectral Sensitizing Dye B-1. The thus obtained silver chlorobromide emulsion (average grain size: 0.86 μm, cubic grains having variation coefficient of grain size distribution of 7%, silver bromide: 40 mol %) was designated Emulsion 103. In this case, the addition amount of potassium hexachloroiridate(IV) was 0.006 mg, the addition amount of 1-(3-methylureidophenyl)-5-mercaptotetrazole was 90 mg, and Compound R-2 was not added.

Spectral sensitizing dyes that were used in each emulsion were as follows.

Spectral Sensitizing Dye R-1

1/1 mixture by mol ratio of

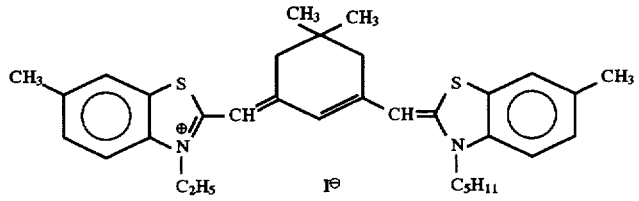

and

-continued
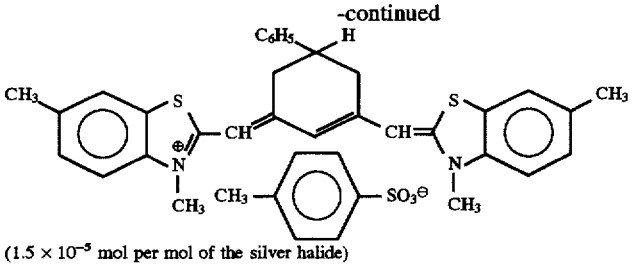
($1.5 \times 10^{-5}$ mol per mol of the silver halide)
Compound R-2
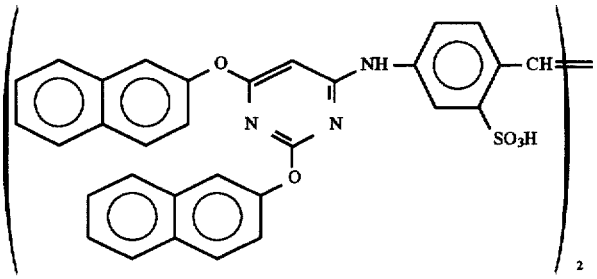
Spectral Sensitizing Dye G-1
6/1/3 mixture by mol ratio of
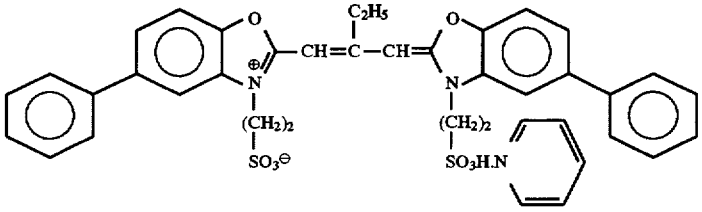
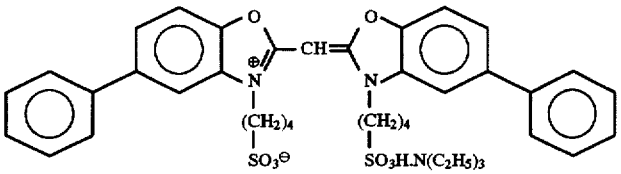
and
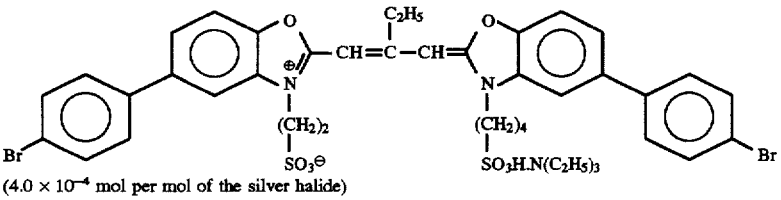
($4.0 \times 10^{-4}$ mol per mol of the silver halide)
Spectral Sensitizing Dye B-1
5/2/3 by mol ratio of
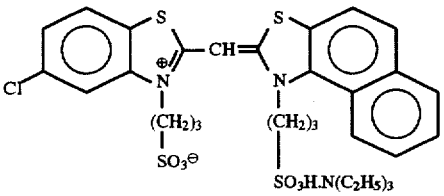

-continued

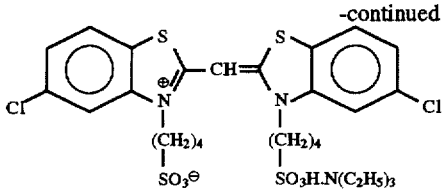

and

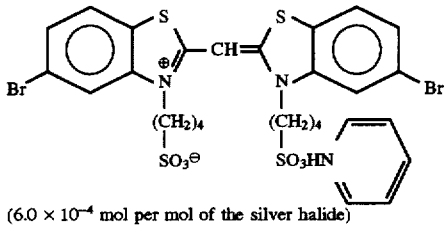

($6.0 \times 10^{-4}$ mol per mol of the silver halide)

A multilayer color photographic material was prepared using these emulsions. A coating solution was prepared as follows.

Preparation of Coating Solution for First Layer 122.0 g of a yellow coupler (ExY), 15.4 g of a color image stabilizer (Cpd-1), 7.5 g of a color image stabilizer (Cpd-2), 16.7 g of a color image stabilizer (Cpd-3) were dissolved in 44 g of a solvent (Solv-1) and 180 cc of ethyl acetate, and this solution was mixed to 1,000 g of a 10% aqueous solution of gelatin containing 86 cc of 10% sodium dodecylbenzenesulfonate and dispersed in an emulsified condition with vigorously stirring using a homogenizer to obtain Emulsified Dispersion A. This Emulsified Dispersion A was mixed with the foregoing Emulsion 103 and dissolved, and the amount of gelatin was adjusted to obtain a coating solution for the first layer having the composition described below. The coating amount of the emulsion was calculated in terms of silver.

The coating solutions for the second to seventh layers were prepared in the same manner as the coating solution for the first layer. 1-Oxy-3,5-dichloro-s-triazine sodium salt was used as a gelatin hardening agent in each layer.

Further, Cpd-12, Cpd-13, Cpd-14 and Cpd-15 were added to each layer so that the total coating amount becomes 15 mg/m$^2$, 60 mg/m$^2$, 5 mg/m$^2$ and 10 mg/m$^2$, respectively. Further, 1-(5-methylureidophenyl)-5-mercaptotetrazole was added to the second, fourth, sixth and seventh layers so as to provide a coating amount of 0.15 mg/m$^2$, 0.15 mg/m$^2$, 0.6 mg/m$^2$ and 0.1 mg/m$^2$ respectively In addition, 4-hydroxy-6-methyl-1,3,3a, 7-tetraazaindene was added to the first and third layers in an amount of $1\times10^{-4}$ mol and $2\times10^{-4}$ mol, respectively, per mol of the silver halide.

Moreover, the following water-soluble dyes were added to emulsion layers for preventing irradiation (the numerals in parentheses represent the coating amount).

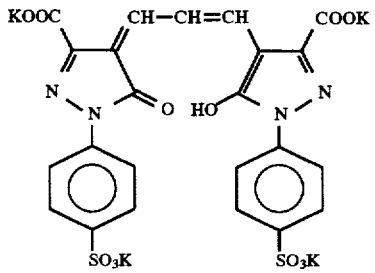

(10mg/m$^2$)

and

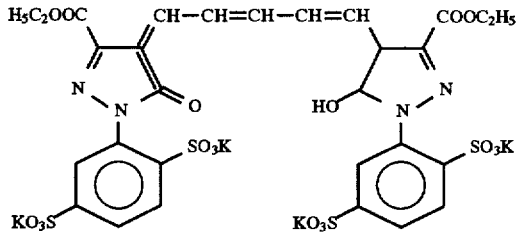

(40 mg/m$^2$)

The surface of a paper support laminated on both sides with polyethylene (the laminated layer on the emulsion coating side comprised two layers of an upper layer having a thickness of 17 μm containing 19% of $TiO_2$ and a trace amount of ultramarine and a lower layer having a thickness of 10 μm not containing $TiO_2$) was corona discharged. The support was provided with an undercoat layer containing sodium dodecylbenzenesulfonate, and further, the above coating solutions were multilayer coated to have the following composition and a multilayer color photographic paper Sample 101 was prepared.

Layer Constitution

The composition of each layer is described below. The numeral represents the coating amount (g/m$^2$). The coating amount of the silver halide emulsion represents the coating amount in terms of silver.

Support:

Polyethylene-laminated paper (a white pigment ($TiO_2$) and a blue dye (ultramarine) were added to the polyethylene of the first layer side).

| | |
|---|---|
| **First Layer (blue-sensitive emulsion layer)** | |
| Silver Chlorobromide Emulsion 103 described above | 0.30 |
| Gelatin | 1.33 |
| Yellow Coupler (ExY) | 0.76 |
| Color Image Stabilizer (Cpd-1) | 0.10 |
| Color Image Stabilizer (Cpd-2) | 0.05 |
| Color Image Stabilizer (Cpd-3) | 0.10 |
| Solvent (Solv-1) | 0.28 |
| **Second Layer (color mixture preventing layer)** | |
| Gelatin | 1.09 |
| Color Mixing Preventive (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.09 |
| **Third Layer (green-sensitive emulsion layer)** | |
| Silver Chlorobromide Emulsion 102 described above | 0.15 |
| Gelatin | 1.19 |
| Magenta Coupler (ExM) | 0.15 |
| Ultraviolet Absorber (UV-1) | 0.15 |
| Color Image Stabilizer (Cpd-2) | 0.013 |
| Color Image Stabilizer (Cpd-5) | 0.013 |
| Color Image Stabilizer (Cpd-6) | 0.013 |
| Color Image Stabilizer (Cpd-7) | 0.10 |
| Color Image Stabilizer (Cpd-8) | 0.013 |
| Solvent (Solv-4) | 0.38 |
| Solvent (Solv-5) | 0.19 |
| **Fourth Layer (color mixture preventing layer)** | |
| Gelatin | 0.77 |
| Color Mixing Preventive (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| **Fifth Layer (red-sensitive emulsion layer)** | |
| Silver Chlorobromide Emulsion 101 described above | 0.25 |
| Gelatin | 1.00 |
| Cyan Coupler (ExC) | 0.35 |
| Ultraviolet Absorber (UV-3) | 0.24 |
| Color Image Stabilizer (Cpd-1) | 0.30 |
| Color Image Stabilizer (Cpd-6) | 0.013 |
| Color Image Stabilizer (Cpd-8) | 0.013 |
| Color Image Stabilizer (Cpd-9) | 0.05 |
| Color Image Stabilizer (Cpd-10) | 0.013 |
| Solvent (Solv-1) | 0.013 |
| Solvent (Solv-6) | 0.26 |
| **Sixth Layer (ultraviolet absorbing layer)** | |
| Gelatin | 0.64 |
| Ultraviolet Absorber (UV-2) | 0.39 |
| Color Image Stabilizer (Cpd-7) | 0.05 |
| Solvent (Solv-8) | 0.05 |
| **Seventh Layer (protective layer)** | |
| Gelatin | 0.98 |
| Acryl-Modified Copolymer of Polyvinyl Alcohol (modification degree: 17%) | 0.04 |
| Liquid Paraffin | 0.01 |
| Surfactant (Cpd-11) | 0.01 |

(ExY) Yellow Coupler
1/1 mixture by mol ratio of

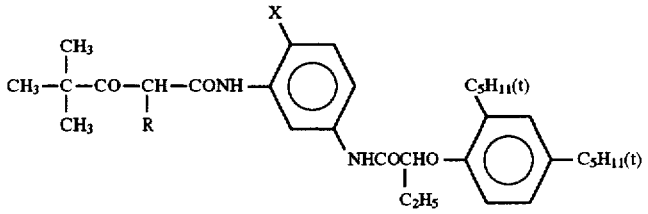

-continued
R = 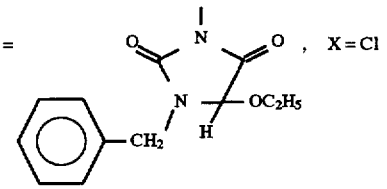
R = 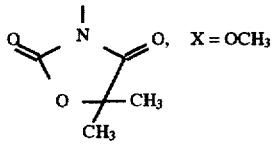
(ExM) Magenta Coupler
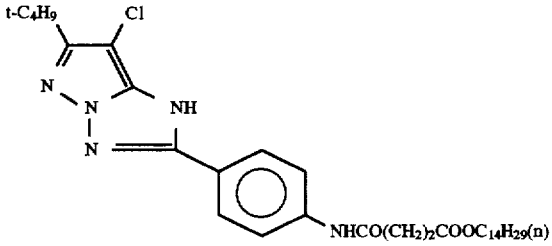
(ExC) Cyan Coupler
25/75 mixture by mol ratio of
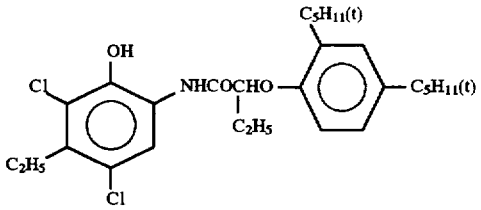
and
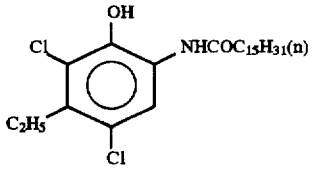
(Cpd-1) Color Image Stabilizer
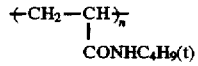
number average molecular weight: 60,000
(Cpd-2) Color Image Stabilizer
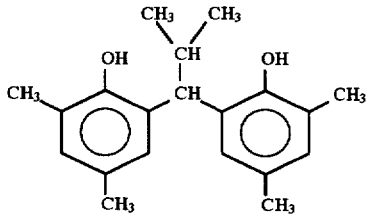
(Cpd-3) Color Image Stabilizer -continued
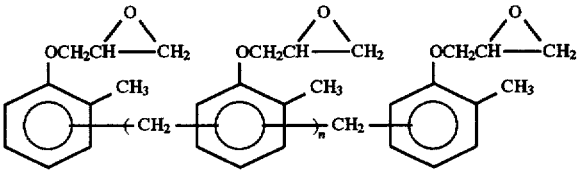
n = 7–8 (average value)
(Cpd-4) Color Mixing Preventive
1/1/1 mixture by weight ratio of
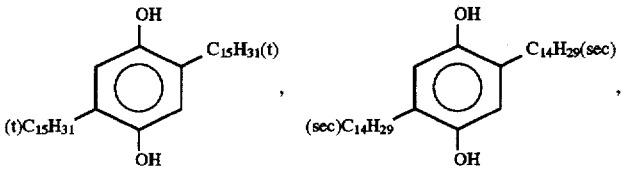
and
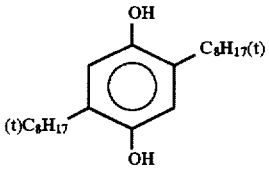
(Cpd-5) Color Image Stabilizer
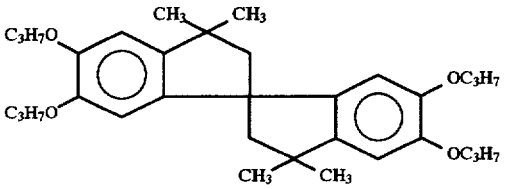
(Cpd-6) Color Image Stabilizer
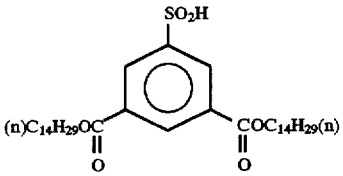
(Cpd-7) Color Image Stabilizer
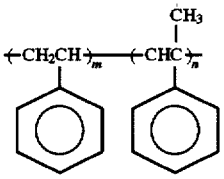
number average molecular weight: 600
m/n = 10/90
(Cpd-8) Color Image Stabilizer
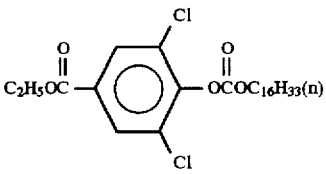

(Cpd-9) Color Image Stabilizer
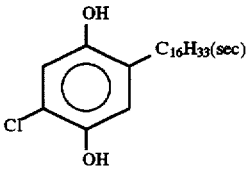
(Cpd-10) Color Image Stabilizer
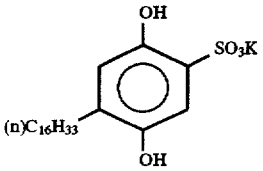
(Cpd-11) Surfactant
7/3 mixture by weight ratio of
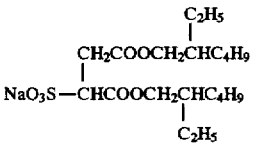
and
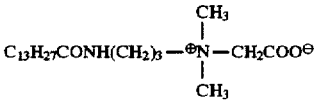
(Cpd-12) Preservative
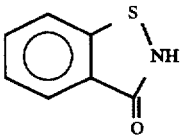
(Cpd-13) Preservative
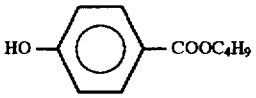
(Cpd-14) Preservative
1/1/1/1 mixture of a/b/c/d
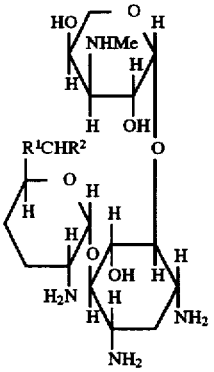

-continued
| | $R^1$ | $R^2$ |
|---|---|---|
| a | −Me | −NHMe |
| b | −Me | $-NH_2$ |
| c | −H | $-NH_2$ |
| d | −H | −NHMe |
(Cpd-15) Preservative
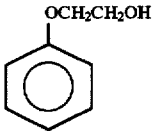
(UV-1) Ultraviolet Absorber
1/3/4 mixture by weight ratio of
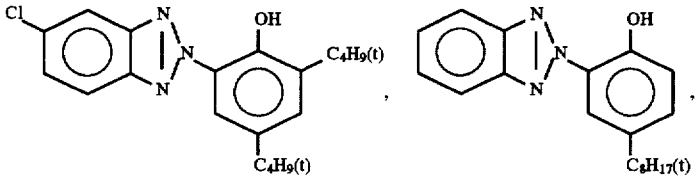
and
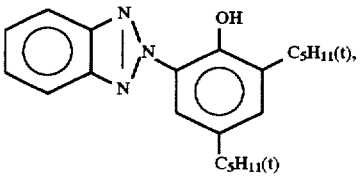
(UV-2) Ultraviolet Absorber
1/2/2/3/1 mixture by weight ratio of
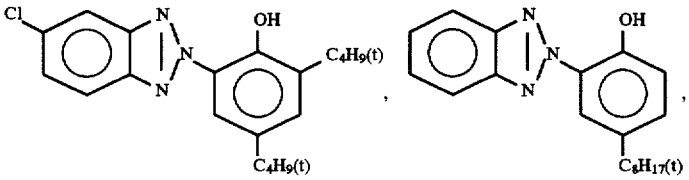
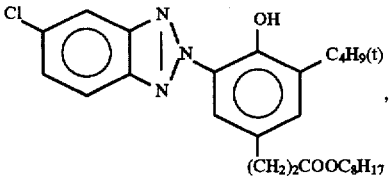
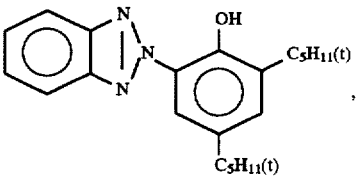
and
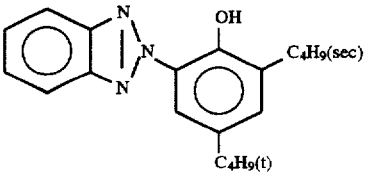

-continued
(UV-3) Ultraviolet Absorber
1/3/2/1 mixture by weight ratio of
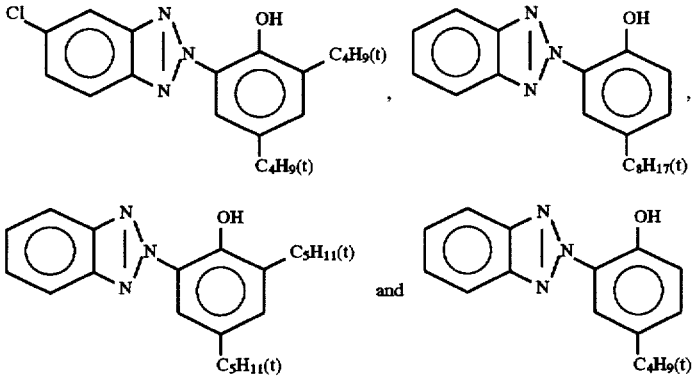
(Solv-1) Solvent
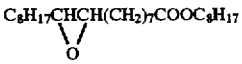
(Solv-2) Solvent
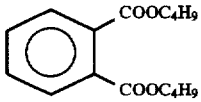
(Solv-3) Solvent
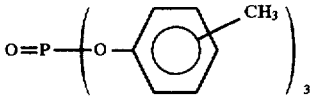
(Solv-4) Solvent
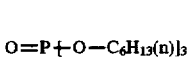
(Solv-5) Solvent
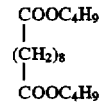
(Solv-6) Solvent
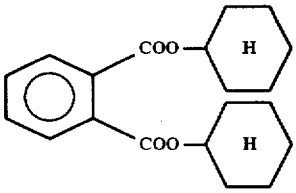
(Solv-7) Solvent
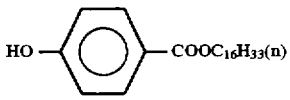

-continued (Solv-8) Solvent $$\begin{array}{l} COOC_8H_{17} \\ | \\ (CH_2)_8 \\ | \\ COOC_8H_{17} \end{array}$$

The above sample was processed according to the following processing step using an automatic processor for color papers (the open factor of the color developing solution: 0.005 $cm^{-1}$, the carryover of the color developing solution by the photographic material: 30 $ml/m^2$). The linear velocity and the composition of the color developing solution in the processing were changed as shown in Table A below.

Processing Step

| Processing Step | Processing Temperature (°C.) | Processing Time (sec) |
|---|---|---|
| Color Development | 38.5 | 45 |
| Bleach-Fixing | 38.0 | 45 |
| Rinsing (1) | 38.0 | 20 |
| Rinsing (2) | 38.0 | 20 |
| Rinsing (3) | 38.0 | 20 |
| Rinsing (4) | 38.0 | 20 |

Rinsing was conducted in a four-tank countercurrent system from rinsing (4) to (1).

The composition of each processing solution used is described below.

| | Tank Solution |
|---|---|
| Color Developing Solution | |
| Cation Exchange Water | 800 ml |
| Dimethylpolysiloxane Surfactant (Silicone KF351A, a product of Shin-Etsu Chemical Co., Ltd.) | 0.1 g |
| Lithium Sulfate | 4.5 g |
| Ethylenediaminetetraacetic Acid | 4.0 g |
| Sodium 4,5-Dihydroxybenzene-1,3-disulfonate | 0.5 g |
| Potassium Chloride | 10.0 g |
| Potassium Bromide | 0.040 g |
| Triazinyl-4,4-diaminostilbene Brightening Agent (Hakkol FWA-SF, a product of Showa Kagaku Kogyo Co., Ltd.) | 2.5 g |
| Sodium Sulfite | 0.1 g |
| Calcium Sulfate | 1.0 g |
| Additive (shown in Table A) | 0.1 mol |
| Disodium-N,N-bis(sulfonatoethyl)-hydroxylamine | 8.5 g |
| N-Ethyl-N-(β-methanesulfonamido-ethyl)-3-methyl-4-amino-4-amino-aniline.3/2 Sulfate.Monohydrate | 5.0 g |
| Potassium Carbonate | 26.3 g |
| Water to make | 1,000 ml |
| pH (25° C., adjusted with KOH or sulfuric acid) | 10.15 |
| Bleach-Fixing Solution | |
| Water | 700 ml |
| Ammonium Thiosulfate (750 g/liter) | 100 ml |
| Ammonium Sulfite | 35.0 g |
| Ammonium Ethylenediamine-tetraacetato Ferrate | 43.0 g |
| m-Carboxybenzenesulfinic Acid | 0.2 mol |
| Imidazole | 7.7 g |
| Water to make | 1,000 ml |
| pH (25° C., adjusted with nitric acid or aqueous ammonia) | 7.00 |
| Rinsing Solution (the tank solution and the replenisher are the same) | |
| Sodium Chlorinated Isocyanurate | 0.02 g |
| Deionized water (electric conductivity: 5 μs/cm or less) | 1,000 ml |
| pH | 6.5 |

The above coated sample was subjected to continuous wedge exposure of three color separation using a sensitometer (FWH type, color temperature of the light source: 3,200K, a product of Fuji Photo Film Co., Ltd.) (exposure amount: 0.1 sec., 250 CMS) and processed.

Subsequently, the above bleach-fixing solution was added to the above color developing solution in an amount of 0.5 ml per liter of the color developing solution and processed in the same manner.

The change in sensitivity (the change of logE value at density 0.7, ΔlogE=the value after the mixture of the bleach-fixing solution minus the value before the mixture of the bleach-fixing solution) and the change in gradation (the change of γ=the density at the point of sensitivity higher by logE 0.5 than the point of sensitivity at density 0.7 minus 0.7, Δγ=the value after the mixture of the bleach-fixing solution minus the value before the mixture of the bleach-fixing solution) of the cyan coloring layer before and after the addition of the bleach-fixing solution to the color developing solution were measured using a Macbeth densitometer and the results obtained are shown in Table A.

TABLE A

| Experiment No. | Additive | Linear Velocity of Conveyance (mm/min.) | ΔlogE | Δγ | Remarks |
|---|---|---|---|---|---|
| 1 | None | 500 | +0.038 | +0.078 | Comparison |
| 2 | " | 2,000 | +0.049 | +0.089 | " |
| 3 | " | 20,000 | +0.061 | +0.113 | " |
| 4 | Triethanolamine | 500 | +0.045 | +0.089 | " |
| 5 | " | 2,000 | +0.059 | +0.099 | " |
| 6 | " | 20,000 | +0.078 | +0.128 | " |
| 7 | Diethanolamine | 2,000 | +0.061 | +0.101 | " |
| 8 | Monoethanolainine | 2,000 | +0.063 | +0.108 | " |
| 9 | Diisopropanolamine | 2,000 | +0.058 | +0.098 | " |
| 10 | Monoisopropanolamine | 2,000 | +0.060 | +0.100 | " |
| 11 | Triisopropanolamine | 500 | +0.040 | +0.088 | " |
| 12 | " | 800 | +0.040 | +0.084 | " |
| 13 | " | 1,100 | +0.015 | +0.028 | Invention |
| 14 | " | 1,500 | +0.008 | +0.014 | " |
| 15 | Triisopropanolamine | 2,000 | +0.003 | +0.008 | Invention |
| 16 | " | 5,000 | +0.003 | +0.006 | " |
| 17 | " | 10,000 | +0.002 | +0.005 | " |
| 18 | " | 20,000 | +0.001 | +0.004 | " |

It can be seen from the results in Table A that fluctuations in sensitivity and gradation by the mixture of the bleach-fixing solution to the color developing solution are extremely prevented by the combination of triisopropanolamine and linear velocity of conveyance according to the present invention.

Further, in the present invention, when the conveying rate is 1,500 mm/min. or more is preferred and particularly preferred results could be obtained when the conveying rate is 2,000 mm/min. or more.

EXAMPLE 2

A color photographic paper was prepared according to the method shown below.

Preparation of Support 30 wt % of titanium dioxide was added to a low density polyethylene of MRF=3, 3.0 wt % of zinc stearate based on the amount of the titanium dioxide was added thereto, and kneaded in a Banbury mixer together with an ultramarine blue dye (DV-1 manufactured by Daiichi Kasei Kogyo K.K.), and used for melt extrusion. The size of the titanium dioxide used was from 0.15 μm to 0.35 μm by an electron microscope, and the coating amount of hydrated aluminum oxide was 0.75 wt % based on titanium dioxide in the form of $Al_2O_3$.

After a paper substrate weighing 170 g/m$^2$ was corona discharged at 10 kVA, the above polyethylene composition of 30 wt % of titanium dioxide, the polyethylene composition of 18 wt % of titanium dioxide prepared in the same manner, and the polyethylene containing an ultramarine blue dye but not containing the polyethylene composition of 30 wt % of titanium dioxide were melt extruded at 320° C. using a multilayer extrusion coating die on the above paper substrate to obtain a polyethylene laminate layer comprising the film thicknesses of the upper layer of 2 μm (titanium dioxide: 18 wt %), the intermediate layer of 21 μm (titanium dioxide: 30 wt %) and the lower layer of 10 μm (titanium dioxide: 0 wt %) (the lower layer is nearer the paper substrate). The surface of the polyethylene layer was treated by glow discharge.

Preparation of Color Photographic Paper

Various photographic constitutional layers were coated on the above reflective support and a multilayer color photographic paper having the layer constitution shown below was prepared. The coating solution was prepared as described below.

Preparation of Coating Solution for Third Layer 40.0 g of a magenta coupler (ExM), 40.0 g of an ultraviolet absorber (UV-2), 7.5 g of a color image stabilizer (Cpd-2), 25.0 g of a color image stabilizer (Cpd-5), 2.5 g of a color image stabilizer (Cpd-6), 20.0 g of a color image stabilizer (Cpd-7), 2.5 g of a color image stabilizer (Cpd-8), 5.0 g of a color image stabilizer (Cpd-10) were dissolved in 32.5 g of a solvent (Solv-3), 97.5 g of a solvent (Solv-4), 65.0 g of a solvent (Solv-6) and 110 ml of ethyl acetate, and this solution was dispersed in an emulsified condition in 1,500 g of a 7% aqueous solution of gelatin containing 90 ml of 10% sodium dodecylbenzenesulfonate to obtain Emulsified Dispersion A-1. On the other hand, two kinds of silver chlorobromide Emulsions B-1 were prepared (a cubic form, a mixture in a ratio of ⅓ (silver mol ratio) of a large grain size emulsion having an average grain size of 0.55 μm, and a small grain size emulsion having an average grain size of 0.39 μm; variation coefficients of the grain size distribution were 0.08 and 0.06, respectively, both of them contained 0.8 mol % of silver bromide localized at a part of the grain surface, and the remaining substrate being comprising silver chloride, and potassium hexachloroiridate(IV) in the total amount of 0.1 mg and potassium ferrocyanide in the total amount of 1.0 mg, respectively, were contained in the inside and at the silver bromide rich localized phase of the grains). The green-sensitive Sensitizing Dyes D, E and F shown below were added in an amount of $3.0\times10^{-4}$ mol, $4.0\times10^{-5}$ mol and $2.0\times10^{-4}$ mol, respectively, per mol of silver, to the large grain size emulsion, and $3.6\times10^{-4}$ mol, $7.0\times10^{-5}$ mol and $2.8\times10^{-4}$ mol, respectively, per mol of silver, to the small grain size emulsion. Subsequently, chemical sensitization was conducted optimally by the addition of a sulfur sensitizer and a gold sensitizer in the presence of the decomposition product of a nucleic acid. The foregoing Emulsified Dispersion A-1 was mixed with this silver chlorobromide Emulsion B-1 and dissolved to obtain a coating solution for the third layer having the composition described below.

The coating solutions for the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12 and Cpd-13 were added to each layer so that the total coating amount became 25.0 mg/m$^2$ and 50.0 mg/m$^2$, respectively.

The grain size of the silver chlorobromide emulsion of each light-sensitive emulsion layer was adjusted in the same preparation method as the above silver chlorobromide Emulsion B-1 and the spectral sensitizing dyes described below were used in the silver chlorobromide emulsion of each light-sensitive emulsion layer.

Sensitizing Dyes for Blue-Sensitive Emulsion Layer

Spectral Sensitizing Dye A

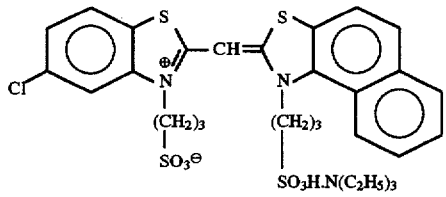

Spectral Sensitizing Dye B

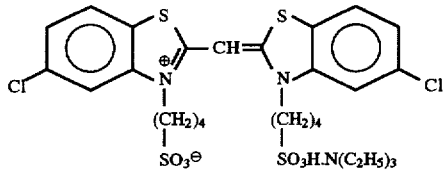

Spectral Sensitizing Dye C

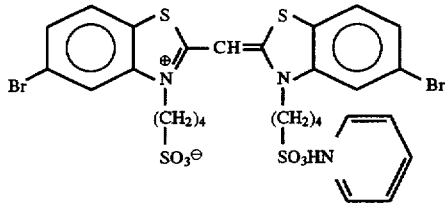

(each in an amount of $1.4\times10^{-4}$ mol per mol of the silver halide to the large grain size emulsion, and each in an amount of $1.7\times10^{-4}$ mol per mol of the silver halide to the small grain size emulsion)

Green-Sensitive Emulsion Layer

Spectral Sensitizing Dye D

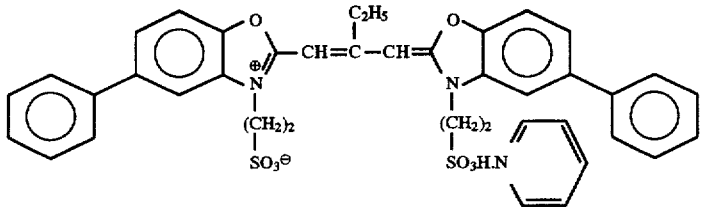

(in an amount of $3.0\times10^{-4}$ mol per mol of the silver halide to the large grain size emulsion and in an amount of $3.6\times10^{-4}$ mol per mol of the silver halide to the small grain size emulsion)

Spectral Sensitizing Dye E

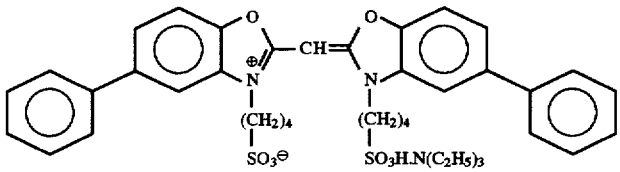

(in an amount of $4.0\times10^{-5}$ mol per mol of the silver halide to the large grain size emulsion and in an amount of $7.0\times10^{-5}$ mol per mol of the silver halide to the small grain size emulsion)

Spectral Sensitizing Dye F

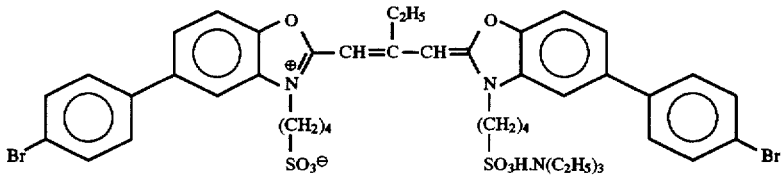

(in an amount of $2.0\times10^{-4}$ mol per mol of the silver halide to the large grain size emulsion and in an amount of $2.8\times10^{-4}$ mol per mol of the silver halide to the small grain size emulsion)

Red-Sensitive Emulsion Layer

Spectral Sensitizing Dye G

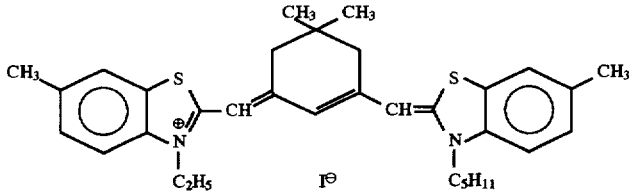

(in an amount of $4.0\times10^{-5}$ mol per mol of the silver halide to the large grain size emulsion and in an amount of $5.0\times10^{-5}$ mol per mol of the silver halide to the small grain size emulsion)

Spectral Sensitizing Dye H

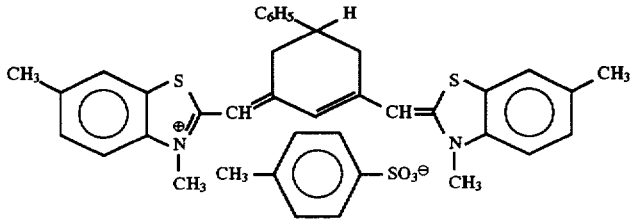

(in an amount of $5.0\times10^{-5}$ mol per mol of the silver halide to the large grain size emulsion and in an amount of $6.0\times10^{-5}$ mol per mol of the silver halide to the small grain size emulsion)

Further, the following compound was added to the red-sensitive silver halide emulsion in an amount of $2.6\times10^{-3}$ mol per mol of the silver halide.

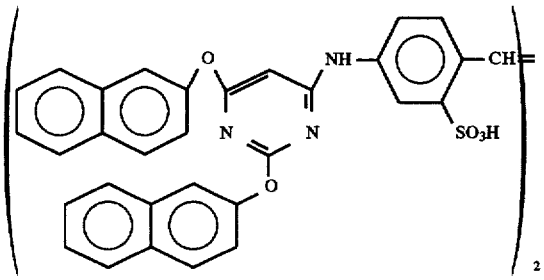

Further, 1-(5-methylureidophenyl)-5-mercaptotetrazole was added to the blue-sensitive emulsion layer, the green-sensitive sensitive emulsion layer and the red-sensitive emulsion layer in an amount of $8.5\times10^{-4}$ mol, $3.0\times10^{-3}$ mol and $2.5\times10^{-4}$ mol, respectively, per mol of the silver halide.

In addition, 4-hydroxy-6-methyl-1,3,3a, 7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes were added to each emulsion layer for preventing irradiation (the numerals in parentheses represent the coating amount).

Yellow Dye

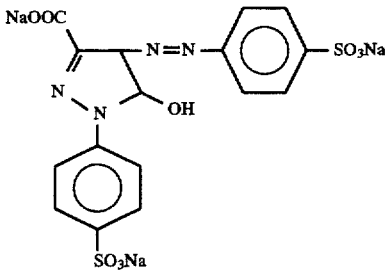

(2.6mg/m²)

-continued

Magenta Dye

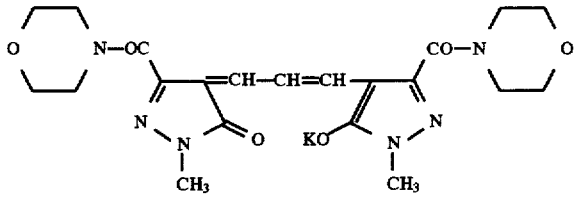

(60mg/m²)

Cyan Dye

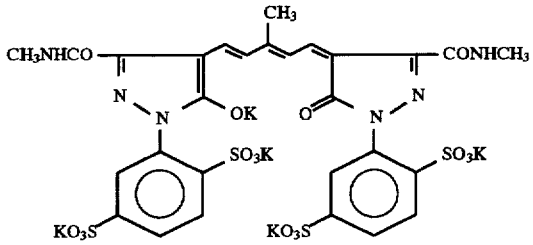

(42mg/m²)

Layer Composition

The composition of each layer is described below. The numeral represents the coating amount (g/m2). The numeral for silver halide emulsion represents the coating amount in terms of silver.

Support (A):

A blue dye (ultramarine blue) was added to the polyethylene layer of the first layer side.

First Layer (blue-sensitive emulsion layer)

| | |
|---|---|
| Silver Chlorobromide Emulsion A-1 (a cubic form, a mixture in a ratio of 5/5 (silver mol ratio) of a large grain size emulsion having an average grain size of 0.88 μm and a small grain size emulsion having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride, and potassium hexachloroiridate(IV) in the total amount of 0.1 mg and potassium ferrocyanide in the total amount of 1.0 mg, respectively, were contained in the inside and at the silver bromide rich localized phase of the grains) | 0.27 |
| Gelatin | 1.22 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.01 |

-continued

| | |
|---|---|
| Solvent (Solv-1) | 0.13 |
| Solvent (Solv-5) | 0.13 |
| Second Layer (color mixture preventing layer) | |
| Gelatin | 0.90 |
| Color Mixing Preventive (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (green-sensitive emulsion layer) | |
| Silver Chlorobromide Emulsion B-1 described above | 0.13 |
| Gelatin | 0.45 |
| Magenta Coupler (ExM) | 0.16 |
| Ultraviolet Absorber (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fourth Layer (color mixture preventing layer) | |
| Gelatin | 0.68 |
| Color Mixing Preventive (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (red-sensitive emulsion layer) | |
| Silver Chlorobromide Emulsion C-1 (a cubic form, a mixture in a ratio of ¼ (silver mol ratio) of a large grain size emulsion having an average grain size of 0.50 μm and a small grain size emulsion having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride, and further, potassium hexachloroiridate(IV) in the total amount of 0.3 mg and potassium ferrocyanide in the total amount of 1.5 mg, respectively, per mol of the silver were contained in the inside and at the silver bromide rich localized phase of the grains) | 0.18 |
| Gelatin | 0.80 |
| Cyan Coupler (ExC) | 0.33 |
| Ultraviolet Absorber (UV-2) | 0.18 |
| Color Image Stabilizer (Cpd-1) | 0.33 |
| Color Image Stabilizer (Cpd-2) | 0.03 |
| Color Image Stabilizer (Cpd-6) | 0.01 |
| Color Intage Stabilizer (Cpd-8) | 0.01 |
| Color Image Stabilizer (Cpd-9) | 0.02 |
| Color Image Stabilizer (Cpd-10) | 0.01 |
| Solvent (Solv-1) | 0.01 |
| Solvent (Solv-7) | 0.22 |
| Sixth Layer (ultraviolet absorbing layer) | |
| Gelatin | 0.48 |
| Ultraviolet Absorber (UV-1) | 0.38 |
| Color Image Stabilizer (Cpd-5) | 0.01 |
| Color Image Stabilizer (Cpd-7) | 0.05 |
| Solvent (Solv-9) | 0.05 |
| Seventh Layer (protective layer) | |
| Gelatin | 0.90 |
| Acryl-Modified Copolymer of Polyvinyl Alcohol (modification degree: 17%) | 0.05 |
| Liquid Paraffin | 0.02 |
| Color Image Stabilizer (Cpd-11) | 0.01 |

(ExY) Yellow Coupler
1/1 mixture by mol ratio of

-continued
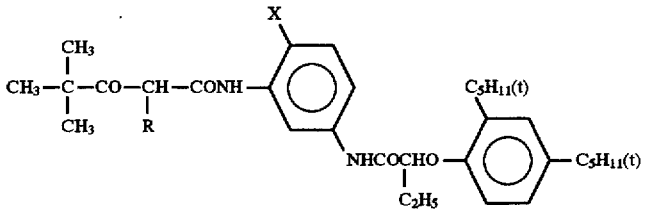
R = 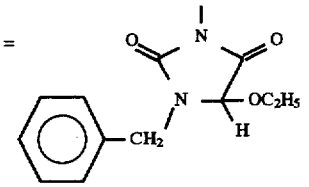 X = Cl
and
R = 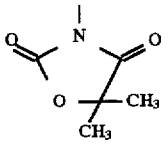 X = $OCH_3$
(ExM) Magenta Coupler
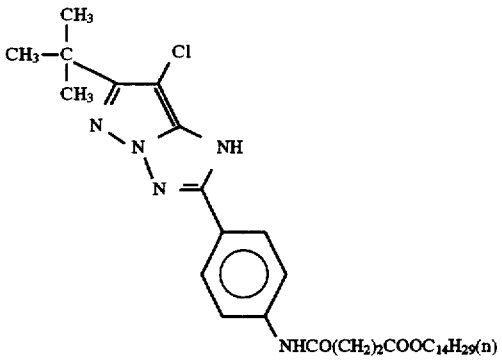
(ExC) Cyan Coupler
25/75 mixture by mol ratio of
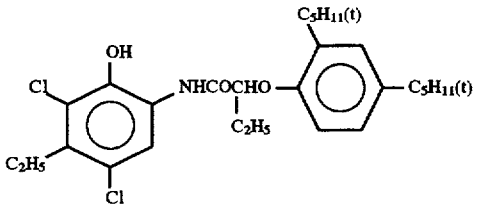
and
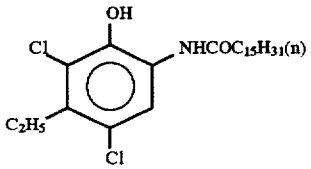
(Cpd-1) Color Image Stabilier -continued
$$\left(CH_2-\underset{\substack{|\\ CONHC_4H_9(t)}}{CH}\right)_n$$
number average molecular weight: 60,000
(Cpd-2) Color Image Stabilizer
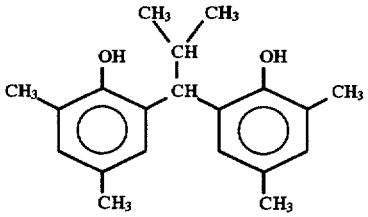
(Cpd-3) Color Image Stabilizer
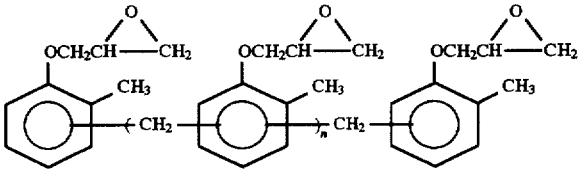
n = 7–8 (average value)
(Cpd-4) Color Mixture Inhibitor
1/1/1 mixture by weight ratio of
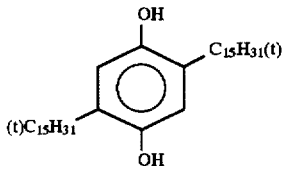
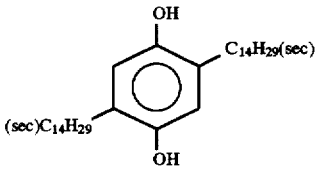
and
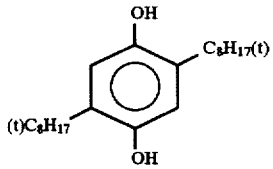
(Cpd-5) Color Image Stabilizer
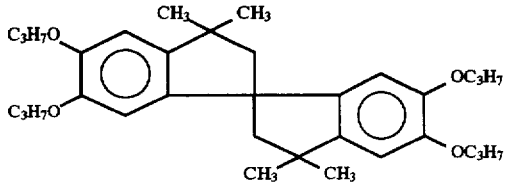
(Cpd-6) Color Image Stabilizer
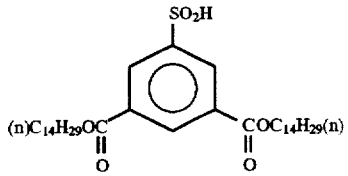
(Cpd-7) Color Image Stabilizer -continued
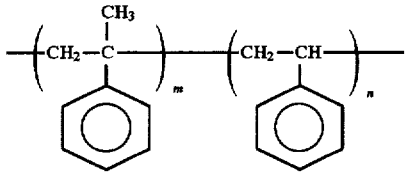
m/n = 9/1
number average molecular weight: 600
(Cpd-8) Color Image Stabilizer
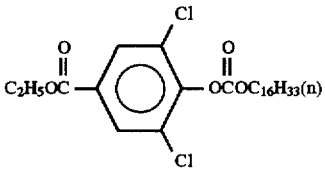
(Cpd-9) Color Image Stabilizer
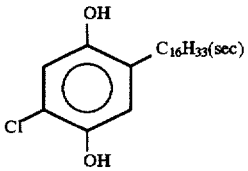
(Cpd-10) Color Image Stabilizer
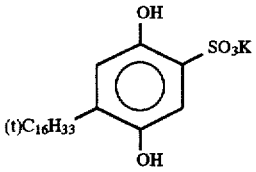
(Cpd-11) Color Image Stabilizer
1/2/1 mixture by weight ratio of i)/ii)/iii)
i)
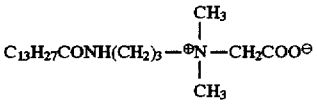
ii)
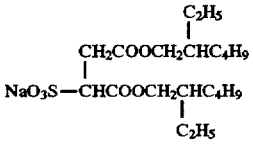
iii)
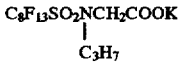
(Cpd-12) Preservative
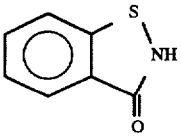
(Cpd-13) Preservative -continued
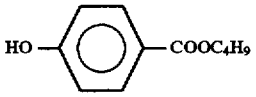
(UV-1) UV Absorbing Agent
1/2/2/3/1 mixture by weight ratio of (iv)/(v)/(vi)/(vii)/(viii)
(iv)
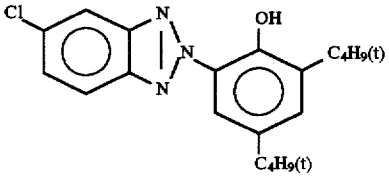
(v)
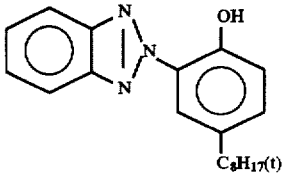
(vi)
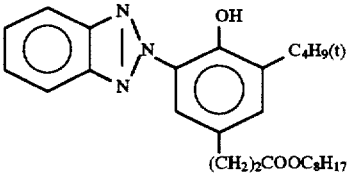
(vii)
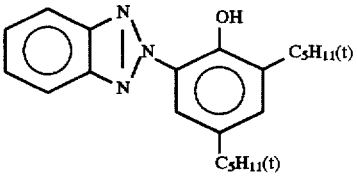
(viii)
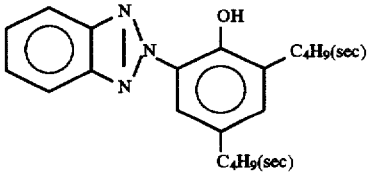
(UV-2) UV Absorbing Agent
2/3/4/1 mixture by weight ratio of (ix)/(x)/(xi)/(xii)
(ix)
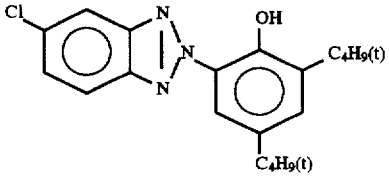
(x)
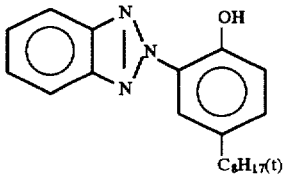

-continued
(xi)
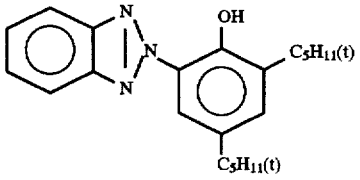
(xii)
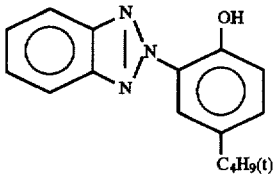
(Solv-1) Solvent
$C_8H_{17}CH(O)CH(CH_2)_7COOC_8H_{17}$
(Solv-2) Solvent
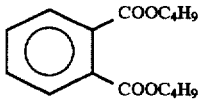
(Solv-3) Solvent
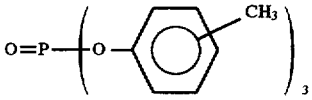
(Solv-4) Solvent
$O{=}P{+}O{-}C_6H_{13}(n)]_3$
(Solv-5) Solvent
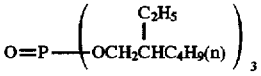
(Solv-6) Solvent
$COOC_4H_9$
$(CH_2)_8$
$COOC_4H_9$
(Solv-7) Solvent
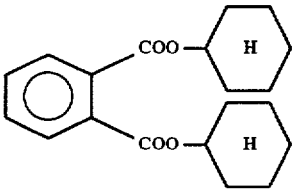
(Solv-8) Solvent
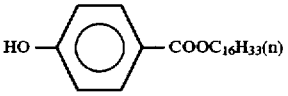
(Solv-9) Solvent -continued $$\begin{array}{l} COOC_8H_{17} \\ | \\ (CH_2)_8 \\ | \\ COOC_8H_{17} \end{array}$$

Processing was conducted with the above photographic material using Fuji Mini Lab paper printer processor PP1827VR produced by Fuji photo Film Co., Ltd. (linear velocity of conveyance: 2,500 mm/min.) according to the following processing steps. The composition of the color developing solution was changed as shown in Table B.

Processing Step

| Processing Step | Processing Temperature (°C.) | Processing Time (sec) |
|---|---|---|
| Color Development | 40.0 | 45 |
| Bleach-Fixing | 38.0 | 45 |
| Rinsing (1) | 38.0 | 20 |
| Rinsing (2) | 38.0 | 20 |
| Rinsing (3) | 38.0 | 20 |
| Rinsing (4) | 38.0 | 30 |

Rinsing was conducted in a four-tank countercurrent system from rinsing (4) to (1).

| | Tank Solution |
|---|---|
| Color Developing Solution | |
| Cation Exchange Water | 800 ml |
| Dimethylpolysiloxane Surfactant (Silicone KF351A, a product of Shin-Etsu Chemical Co., Ltd.) | 0.1 g |
| Lithium Sulfate | Shown in Table B |
| Ethylenediaminetetraacetic Acid | 4.5 g |
| Sodium 4,5-Dihydroxybenzene-1,3-disulfonate | 0.5 g |
| Potassium Chloride | 12.0 g |
| Potassium Bromide | 0.045 g |
| Triazinyl-4,4-diaminostilbene Brightening Agent (Hakkol OW-10EX, a product of Showa Kagaku Kogyo Co., Ltd.) | 1.0 g |
| Sodium Sulfite | 0.1 g |

-continued

| | Tank Solution |
|---|---|
| Calcium Sulfate | Shown in Table B |
| Additive (shown in Table B) | 0.1 mol |
| Disodium-N,N-bis(sulfonatoethyl) hydroxylamine | 8.5 g |
| N-Ethyl-N-(β-methanesulfonamido-ethyl)-3-methyl-4-amino-4-amino-aniline.3/2 Sulfate.Monohydrate | 5.0 g |
| Potassium Carbonate | 26.3 g |
| Water to make | 1,000 ml |
| pH (25° C., adjusted with KOH or sulfuric acid) | 10.15 |
| Bleach-Fixing Solution | |
| Water | 700 ml |
| Ammonium Thiosulfate (750 g/liter) | 100 ml |
| Ammonium Sulfite | 35.0 g |
| Ammonium Ethylenediamine-tetraacetato Ferrate | 43.0 g |
| m-Carboxybenzenesulfinic Acid | 0.2 mol |
| Imidazole | 7.7 g |
| Water to make | 1,000 ml |
| pH (25° C., adjusted with nitric acid or aqueous ammonia) | 7.00 |
| Rinsing Solution (the tank solution and the replenisher are the same) | |
| Sodium Chlorinated Isocyanurate | 0.02 g |
| Deionized water (electric conductivity: 5 μs/cm or less) | 1,000 ml |
| pH | 6.5 |

The above coated sample was processed in the same manner as in Example 1. The above bleach-fixing solution was added to the above color developing solution in an amount of 1.0 ml per liter of the color developing solution, and the changes in sensitivity and gradation of the cyan coloring layer before and after the addition of the bleach-fixing solution to the color developing solution were measured using a Macbeth densitometer and the results obtained are shown in Table B.

TABLE B

| Experiment No. | Additive | Ca Ion Concentration (mol/liter) | Li Ion Concentration (mol/liter) | ΔlogE | Δγ | Remarks |
|---|---|---|---|---|---|---|
| 1 | None | — | — | +0.080 | +0.198 | Comparison |
| 2 | " | $4 \times 10^{-3}$ | $2 \times 10^{-2}$ | +0.081 | +0.201 | " |
| 3 | Triethanolamine | — | — | +0.092 | +0.209 | " |
| 4 | " | $4 \times 10^{-3}$ | $2 \times 10^{-2}$ | +0.092 | +0.208 | " |
| 5 | Monoisopropanolamine | — | — | +0.098 | +0.211 | " |
| 6 | " | $4 \times 10^{-3}$ | $2 \times 10^{-2}$ | +0.097 | +0.212 | " |
| 7 | Triisopropanolamine | — | — | +0.032 | +0.055 | Invention |
| 8 | " | $1 \times 10^{-3}$ | — | +0.014 | +0.028 | " |
| 9 | " | $2 \times 10^{-3}$ | — | +0.009 | +0.015 | " |
| 10 | " | $4 \times 10^{-3}$ | — | +0.005 | +0.009 | " |
| 11 | " | — | $1 \times 10^{-2}$ | +0.014 | +0.027 | " |
| 12 | " | — | $1.5 \times 10^{-2}$ | +0.009 | +0.015 | " |

TABLE B-continued

| Experiment No. | Additive | Ca Ion Concentration (mol/liter) | Li Ion Concentration (mol/liter) | ΔlogE | Δγ | Remarks |
|---|---|---|---|---|---|---|
| 13 | " | — | $2 \times 10^{-2}$ | +0.004 | +0.010 | " |
| 14 | " | $1 \times 10^{-3}$ | $1 \times 10^{-2}$ | +0.007 | +0.017 | " |
| 15 | Triisopropanolamine | $2 \times 10^{-3}$ | $1.5 \times 10^{-2}$ | +0.004 | +0.007 | Invention |
| 16 | " | $4 \times 10^{-3}$ | $2 \times 10^{-2}$ | +0.002 | +0.005 | " |

It can be seen from Table B that, among the present invention, more preferred result can be obtained when calcium ion concentration is $1\times10^{-3}$ mol/liter or more, and still more preferred result can be obtained when calcium ion concentration is $2\times10^{-3}$ mol/liter or more, and particularly preferred result can be obtained when calcium ion concentration is $4\times10^{-3}$ mol/liter or more.

Further, more preferred result can be obtained when lithium ion concentration is $1\times10^{-2}$ mol/liter or more, still more preferred result can be obtained when the concentration is $1.5\times10^{-2}$ mol/liter or more, and particularly preferred result can be obtained when it is $2\times10^{-2}$ mol/liter or more.

In addition, most preferred result can be obtained when calcium ion and lithium ion are used in combination.

EXAMPLE 3

Conditions of the crystallization to the tank wall (ascending of crystals on the tank wall) were evaluated using the color developing solution used in Example 2 according to the following method.

Test pieces were prepared using the tank materials modified PPO (modified polyphenylene oxide) resin, modified PPE (modified polyphenylene ether) resin and PVC (polyvinyl chloride) resin (each 20×20 cm, thickness: 0.5 cm) by cutting five grooves of 0.5 mm in depth and 0.5 mm in width vertically on each of these resin plates.

"Noryl", a product of Nippon G. E. Plastics, as modified PPO resin and "Zailon", a product of Asahi Chemical Industry Co., Ltd., as modified PPE resin were used.

The lower half of each of the above prepared test pieces was immersed in the color developing solution with the grooves being vertical to the liquid level.

After the color developing solution was allowed to stand for three days at 40° C., the conditions of crystals adhered to the test pieces were evaluated. The ascending heights of crystals adhered on the test pieces from the level of the color developing solution and the amounts of crystals adhered on the test pieces (difference of the weights of the test pieces before and after immersion) were measured.

The results obtained are shown in Table C.

TABLE C

| | | | | Modified PPO | | Modified PPE | | PVC | | |
|---|---|---|---|---|---|---|---|---|---|---|
| Experiment No. | Additive | Ca Ion Concentration (mol/l) | Li Ion Concentration (mol/l) | Height of Crystal (mm) | Weight of Crystal (mg) | Height of Crystal (mm) | Weight of Crystal (mg) | Height of Crystal (mm) | Weight of Crystal (mg) | Remarks |
| 1 | None | — | — | 38.0 | 53.0 | 34.5 | 48.5 | 33.0 | 45.5 | Comparison |
| 2 | " | $4 \times 10^{-3}$ | $2 \times 10^{-2}$ | 38.5 | 55.0 | 34.5 | 48.5 | 33.5 | 46.0 | " |
| 3 | Triethanolamine | — | — | 39.5 | 61.0 | 37.0 | 55.0 | 34.0 | 50.5 | " |
| 4 | Triethanolamine | $4 \times 10^{-3}$ | $2 \times 10^{-2}$ | 39.5 | 61.5 | 37.5 | 55.5 | 34.0 | 51.0 | " |
| 5 | Monoisopropanolamine | — | — | 37.5 | 60.5 | 36.5 | 53.5 | 34.5 | 53.5 | " |
| 6 | Monoisopropanolamine | $4 \times 10^{-3}$ | $2 \times 10^{-2}$ | 38.0 | 60.0 | 36.5 | 54.5 | 34.5 | 54.0 | " |
| 7 | Triisopropanolamine | — | — | 12.5 | 20.5 | 13.0 | 18.5 | 12.0 | 17.0 | Invention |
| 8 | Triisopropanolamine | $1 \times 10^{-3}$ | — | 7.0 | 11.5 | 7.5 | 10.0 | 6.5 | 9.5 | " |
| 9 | Triisopropanolamine | $2 \times 10^{-3}$ | — | 3.5 | 6.5 | 4.0 | 5.5 | 3.0 | 5.0 | " |
| 10 | Triisopropanolamine | $4 \times 10^{-3}$ | — | 2.0 | 3.5 | 2.0 | 3.0 | 1.5 | 2.5 | Invention |
| 11 | Triisopropanolamine | — | $1 \times 10^{-2}$ | 6.5 | 10.5 | 7.0 | 10.5 | 6.0 | 9.5 | " |
| 12 | Triiso- | — | $1.5 \times 10^{-2}$ | 3.5 | 6.0 | 3.5 | 6.5 | 3.0 | 6.0 | " |

TABLE C-continued

| Experiment No. | Additive | Ca Ion Concentration (mol/l) | Li Ion Concentration (mol/l) | Modified PPO Height of Crystal (mm) | Modified PPO Weight of Crystal (mg) | Modified PPE Height of Crystal (mm) | Modified PPE Weight of Crystal (mg) | PVC Height of Crystal (mm) | PVC Weight of Crystal (mg) | Remarks |
|---|---|---|---|---|---|---|---|---|---|---|
| | propanolamine | | | | | | | | | |
| 13 | Triisopropanolamine | — | $2 \times 10^{-2}$ | 2.5 | 3.0 | 2.5 | 3.5 | 1.5 | 3.0 | " |
| 14 | Triisopropanolamine | $1 \times 10^{-3}$ | $1 \times 10^{-2}$ | 4.0 | 4.5 | 3.5 | 4.0 | 2.0 | 3.5 | " |
| 15 | Triisopropanolamine | $2 \times 10^{-3}$ | $1.5 \times 10^{-2}$ | 2.5 | 3.0 | 2.0 | 2.5 | 1.0 | 2.0 | " |
| 16 | Triisopropanolamine | $4 \times 10^{-3}$ | $2 \times 10^{-2}$ | 1.0 | 1.5 | 1.0 | 1.5 | 0.5 | 1.0 | " |

It can be seen from Table C that, among the present invention, more preferred result can be obtained when calcium ion concentration is $1\times10^{-3}$ mol/liter or more, and still more preferred result can be obtained when calcium ion concentration is $2\times10^{-3}$ mol/liter or more, and particularly preferred result can be obtained when calcium ion concentration is $4\times10^{-3}$ mol/liter or more.

Further, more preferred result can be obtained when lithium ion concentration is $1\times10^{-2}$ mol/liter or more, still more preferred result can be obtained when the concentration is $1.5\times10^{-2}$ mol/liter or more, and particularly preferred result can be obtained when it is $2\times10^{-2}$ mol/liter or more.

In addition, most preferred result can be obtained when calcium ion and lithium ion are used in combination.

EXAMPLE 4

Running test was conducted with the coated samples prepared in Example 2 using Fuji Mini Lab Printer Processor PP720WR (rinse cleaning system RC50D standard equipment type, manufactured by Fuji Photo Film Co., Ltd.) according to the following processing steps and the processing compositions.

The drive motor of PP720WR was modified to have linear velocity of conveyance of 2,392 mm/min., which was twice the linear velocity of the standard specification.

Processing Step

| Processing Step | Processing Temperature (°C.) | Processing Time (sec) | Replenishment Rate* (ml) |
|---|---|---|---|
| Color Development | 40.0 | 22.5 | 45 |
| Bleach-Fixing | 40.0 | 22.5 | part A 17.5/ part B 17.5** |
| Rinsing (1) | 38.0 | 10 | — |
| Rinsing (2) | 38.0 | 10 | — |
| Rinsing (3)*** | 38.0 | 10 | — |
| Rinsing (4)*** | 38.0 | 10 | 90 |

*Replenishing rate per $m^2$ of the photographic material

**Part A and Part B were replenished from each replenishing tank separately.

***Rinse cleaning system RC50D (reverse osmosis membrane module, a product of Fuji Photo Film Co., Ltd.) was installed in rinsing tank (3), the rinsing solution in tank (3) was removed, and the removed solution was supplied to RC50D by a pump. The permeated solution obtained from this tank was supplied to rinsing tank (4) and the concentrated solution was returned back to rinsing tank (3). The pressure of the pump was adjusted to maintain the permeation rate of the solution by this reverse osmosis membrane module of from 200 to 300 ml/min. and the system was circulated for 10 hours a day with controlling temperature.

-continued

| Color Developing Solution | Tank Solution | Replenisher |
|---|---|---|
| Cation Exchange Water | 800 ml | 800 ml |
| Dimethylpolysiloxane Surfactant (Silicone KF351A, a product of Shin-Etsu Chemical Co., Ltd.) | 0.1 g | 0.1 g |
| Triisopropanolamine | 0.2 mol | 0.2 mol |
| Lithium Sulfate | 4.5 g | 4.5 g |
| Ethylenediaminetetraacetic Acid | 4.0 g | 4.0 g |
| Sodium 4,5-Dihydroxybenzene-1,3-disulfonate | 0.5 g | 0.5 g |
| Potassium Chloride | 10.0 g | — |
| Potassium Bromide | 0.040 g | 0.010 g |
| Calcium Sulfate | 0.3 g | 0.3 g |
| Sodium Sulfite | 0.1 g | 0.1 g |
| Brightening Agent | | |
| Hakkol FWA-SF, a product of Showa Kagaku Kogyo Co., Ltd. | 2.5 g | 4.5 g |
| Hakkol OW-10EX, a product of Showa Kagaku Kogyo Co., Ltd. | 1.0 g | 2.0 g |
| Diethylhydroxylamine | 3.0 g | 6.0 g |
| Disodium-N,N-bis(sulfonatoethyl)hydroxylamine | 8.5 g | 11.1 g |
| N-Ethyl-N-(β-methanesulfonamidoethyl)-3-methyl-4-amino-4-aminoaniline.3/2 Sulfate. Monohydrate | 5.0 g | 15.7 g |
| Potassium Carbonate | 26.3 g | 26.3 g |
| Water to make | 1,000 ml | 1,000 ml |
| pH (25° C., adjusted with KOH or sulfuric acid) | 10.15 | 12.45 |

Bleach-Fixing Solution Replenisher

| Part A | |
|---|---|
| Water | 250 ml |
| Ammonium Ethylenediaminetetraacetato Ferrate | 0.23 mol |

-continued

| | |
|---|---|
| Compound (S-7) | 0.18 mol |
| Water to make | 500 ml |
| pH (25° C., adjusted with nitric acid or aqueous ammonia) | 6.0 |
| Part B | |
| Water | 100 ml |
| Ammonium Thiosulfate (750 g/liter) | 210 ml |
| Ammonium Sulfite | 90 g |
| Imidazole | 0.2 mol |
| Water to make | 500 ml |
| pH (25° C., adjusted with nitric acid or aqueous ammonia) | 6.0 |

Bleach-Fixing Tank Solution

Part A and Part B of the above bleach-fixing solution replenisher were added to 500 ml of water in an amount of ml, respectively.

Rinsing Solution (the tank solution and the replenisher are the same)

| | |
|---|---|
| Sodium Chlorinated Isocyanurate | 0.02 g |
| Deionized water (electric conductivity: 5 μs/cm or less) | 1,000 ml |
| pH | 6.5 |

The color developing solution replenisher and the bleach-fixing solution replenisher were each put in the flexible vessel for a processing solution having bellows part described in the present specification and each solution was prepared as follows.

Color Developing Solution Replenisher:

Content volume: 2,500 ml, Vessel D

Bleach-Fixing Solution Replenisher:

Part A: Content volume: 2,000 ml, Vessel C

Part B: Content volume: 2,000 ml, Vessel C

Running test was continuously conducted until the cumulative replenishing amount of the color developing solution reached 30 liters.

The wall of the color development processing tank of the processor was examined after the termination of the above running test, no crystallization was observed and excellent result was obtained.

Further, fluctuations in photographic properties due to the mixture of the bleach-fixing solution was examined in the same manner as in Example 2. Almost no fluctuation was observed in sensitivity and gradation and preferred result was obtained.

The fluctuations in photographic properties, in particular, fluctuations in sensitivity and gradation of a cyan coloring layer due to the mixture of a bleach-fixing solution and a fixing solution to a color developing solution can be conspicuously reduced by the development processing with a color developing solution containing triisopropanolamine using an automatic processor of the linear velocity of conveyance of 1,100 mm/min. or more.

Further, the crystallization to the wall of a color developing solution tank and ascending of crystals on the tank wall, which are the causes of the above-described mixture, can be amazingly reduced according to the present invention.

While the invention has been described in detail and with reference to specific examples thereof, it will be apparent to one skilled in the art that various changes and modifications can be made therein without departing from the spirit and scope thereof.

What is claimed is:

1. A method for processing a silver halide color photographic material comprising a step of processing an exposed silver halide color photographic material with an automatic processor, a color developing solution used in said processing step containing triisopropanolamine, and a conveying rate of said automatic processor being 1,100 mm/min. or more, wherein the color developing solution contains from $2\times10^{-2}$ to $1.5\times10^{-2}$ mol/liter of calcium.

2. A method for processing a silver halide color photographic material as claimed in claim 1, wherein said color developing solution contains triisopropanolamine in an amount of from 0.005 to 2.0 mol/liter.

3. A method for processing a silver halide color photographic material as claimed in claim 2, wherein said color developing solution contains triisopropanolamine in an amount of from 0.01 to 1.0 mol/liter.

4. A method for processing a silver halide color photographic material as claimed in claim 3, wherein said color developing solution contains triisopropanolamine in an amount of from 0.02 to 0.5 mol/liter.

5. A method for processing a silver halide color photographic material as claimed in claim 1, wherein said color developing solution contains from $4\times10^{-3}$ to $1.5\times10^{-2}$ mol/liter or more of calcium.

6. A method for processing a silver halide color photographic material as claimed in claim 1, wherein said color developing solution contains $1\times10^{-2}$ mol/liter or more of lithium.

7. A method for processing a silver halide color photographic material as claimed in claim 5, wherein said color developing solution contains $1\times10^{-2}$ mol/liter or more of lithium.

8. A method for processing a silver halide color photographic material as claimed in claim 6, wherein said color developing solution contains from $1.5\times10^{-2}$ to $5\times10^{-1}$ mol/liter or more of lithium.

9. A method for processing a silver halide color photographic material as claimed in claim 8, wherein said color developing solution contains from $2\times10^{-2}$ to $2\times10^{-1}$ mol/liter or more of lithium.

10. A method for processing a silver halide color photographic material as claimed in claim 1, wherein said conveying rate of said automatic processor is from 1,300 to 60,000 mm/min.

11. A method for processing a silver halide color photographic material as claimed in claim 10, wherein said conveying rate of said automatic processor is from 1,500 to 60,000 mm/min.

12. A method for processing a silver halide color photographic material as claimed in claim 11, wherein said conveying rate of said automatic processor is from 2,000 to 60,000 mm/min.

13. A method for processing a silver halide color photographic material as claimed in claim 12, wherein said conveying rate of said automatic processor is from 3,000 to 60,000 mm/min.

* * * * *